US008985890B2

(12) United States Patent
Miracle

(10) Patent No.: US 8,985,890 B2
(45) Date of Patent: Mar. 24, 2015

(54) VERTICALLY ACTUATED VEHICLE BARRIER SYSTEM

(76) Inventor: Gary D. Miracle, Springboro, OH (US)

( * ) Notice: Subject to any disclaimer, the term of this patent is extended or adjusted under 35 U.S.C. 154(b) by 0 days.

(21) Appl. No.: 13/552,874

(22) Filed: Jul. 19, 2012

(65) Prior Publication Data

US 2013/0189030 A1 Jul. 25, 2013

Related U.S. Application Data

(60) Provisional application No. 61/510,194, filed on Jul. 21, 2011.

(51) Int. Cl.

| | |
|---|---|
| ***E01F 13/00*** | (2006.01) |
| ***E01F 13/04*** | (2006.01) |
| ***E01F 13/12*** | (2006.01) |
| ***E01F 15/12*** | (2006.01) |

(52) U.S. Cl.

CPC ..... *E01F 13/048* (2013.01); *E01F 13/123* (2013.01); *E01F 15/12* (2013.01)

USPC ..... 404/6

(58) Field of Classification Search

None

See application file for complete search history.

(56) References Cited

U.S. PATENT DOCUMENTS

| | | | |
|---|---|---|---|
| 1,403,750 | A | 1/1922 | Donovan et al. |
| 2,189,974 | A | 2/1940 | Buford |
| 2,207,148 | A | 7/1940 | Hall |
| 2,219,127 | A | 10/1940 | Buford |
| 2,397,330 | A | 3/1946 | Sawyer |
| 3,079,711 | A | 3/1963 | Turner |
| 3,128,972 | A | 4/1964 | Fonden et al. |
| 3,468,500 | A | 9/1969 | Carlsson et al. |
| 3,738,599 | A | 6/1973 | Borehag |
| 3,798,855 | A | 3/1974 | Walker |
| 3,810,595 | A | 5/1974 | Doolittle |
| 4,004,857 | A | 1/1977 | Eschen |
| 4,138,095 | A | 2/1979 | Humphrey |
| 4,152,871 | A | 5/1979 | Kardash, Jr. |
| 4,312,600 | A | 1/1982 | Schaaf |
| 4,438,596 | A | 3/1984 | Jones |
| 4,465,262 | A | 8/1984 | Itri |
| 4,490,068 | A | 12/1984 | Dickinson |
| 4,502,812 | A | 3/1985 | Zucker |
| 4,554,695 | A | 11/1985 | Rowland |
| 4,574,523 | A | 3/1986 | Nasatka |
| 4,576,507 | A | 3/1986 | Terio |

(Continued)

OTHER PUBLICATIONS

Screenshots from www.roboticsecuritysystems.com, printed Apr. 17, 2007.

*Primary Examiner* — Thomas B Will
*Assistant Examiner* — Katherine Chu
(74) *Attorney, Agent, or Firm* — Frost Brown Todd LLC

(57) ABSTRACT

A vehicle barrier system comprises a housing, substantially vertical members, a barrier member, and an actuation assembly. The barrier member is coupled with the substantially vertical members. The barrier member is configured to stop a moving vehicle when the substantially vertical members are in a raised position relative to the housing. The actuation assembly is operable to selectively raise and lower the substantially vertical members relative to the housing to selectively deploy and retract the barrier member relative to the housing. The actuation assembly comprises a powered rotary actuator mounted to the barrier member. The actuation assembly is operable to convert rotary motion from the rotary actuator into linear movement of the barrier member. A counterweight provides opposing mass and vertical motion relative to the barrier member.

21 Claims, 28 Drawing Sheets

(56) References Cited

U.S. PATENT DOCUMENTS

| | | | | |
|---|---|---|---|---|
| 4,576,508 | A | 3/1986 | Dickinson | |
| 4,577,991 | A | 3/1986 | Rolow | |
| 4,630,395 | A | 12/1986 | Nasatka | |
| 4,666,331 | A | 5/1987 | Riley | |
| 4,705,426 | A | 11/1987 | Perea | |
| 4,711,608 | A | 12/1987 | Ghusn | |
| 4,715,742 | A | 12/1987 | Dickinson | |
| 4,818,136 | A | 4/1989 | Nasatka | |
| 4,826,349 | A | 5/1989 | Nasatka | |
| 4,850,737 | A | 7/1989 | Nasatka | |
| 4,852,511 | A | 8/1989 | Look | |
| 4,861,185 | A | 8/1989 | Eikelenboon | |
| 4,922,655 | A | 5/1990 | Seal | |
| 4,964,750 | A | 10/1990 | House | |
| 5,030,029 | A | 7/1991 | Johnsen | |
| 5,050,846 | A | 9/1991 | Goodman | |
| 5,118,056 | A | 6/1992 | Jeanise | |
| 5,123,773 | A | 6/1992 | Yodock | |
| 5,131,786 | A | 7/1992 | House | |
| 5,215,399 | A | 6/1993 | Berger | |
| 5,228,237 | A | 7/1993 | Nasatka | |
| 5,245,787 | A | 9/1993 | Swenson et al. | |
| 5,248,215 | A | 9/1993 | Fladung | |
| 5,288,164 | A | 2/1994 | Nasatka | |
| 5,297,921 | A | 3/1994 | Springer et al. | |
| 5,336,033 | A | 8/1994 | Alexander | |
| 5,346,353 | A | 9/1994 | Alexander | |
| 5,466,088 | A | 11/1995 | Nasatka | |
| 5,544,614 | A | 8/1996 | Cushman | |
| 5,605,413 | A | 2/1997 | Brown | |
| 5,626,330 | A | 5/1997 | Young | |
| 5,640,806 | A | 6/1997 | Hall | |
| 5,711,110 | A | 1/1998 | Williams | |
| 5,752,691 | A * | 5/1998 | Bashon et al. | 256/35 |
| 5,775,833 | A | 7/1998 | Little | |
| 5,809,733 | A | 9/1998 | Venegas | |
| 5,871,038 | A | 2/1999 | Gompertz | |
| 5,895,169 | A | 4/1999 | Holm | |
| 5,975,791 | A | 11/1999 | McCulloch | |
| 5,987,616 | A | 11/1999 | Suzuki | |
| 6,071,037 | A | 6/2000 | Holt | |
| 6,099,200 | A | 8/2000 | Pepe | |
| 6,108,977 | A | 8/2000 | Payne et al. | |
| 6,116,805 | A | 9/2000 | Gertz | |
| 6,135,190 | A | 10/2000 | Gompertz | |
| 6,145,571 | A | 11/2000 | Snyder | |
| 6,149,338 | A | 11/2000 | Anderson | |
| 6,158,696 | A | 12/2000 | Brodskiy | |
| 6,312,188 | B1 | 11/2001 | Ousterhout et al. | |
| 6,322,285 | B1 | 11/2001 | Ben | |
| 6,349,503 | B1 | 2/2002 | Gompertz | |
| 6,367,781 | B1 | 4/2002 | Flynn | |
| 6,382,870 | B1 | 5/2002 | Gertz | |
| 6,578,342 | B2 | 6/2003 | Faynor | |
| 6,662,520 | B1 | 12/2003 | Nelson | |
| 6,709,190 | B1 | 3/2004 | Partin | |
| 6,769,833 | B2 | 8/2004 | Dicke | |
| 6,817,805 | B2 | 11/2004 | Mettler | |
| 6,836,222 | B1 | 12/2004 | Carini | |
| 6,866,252 | B2 | 3/2005 | Pulliam | |
| 6,951,434 | B2 | 10/2005 | Yodock | |
| 7,195,422 | B2 | 3/2007 | Hannah | |
| 7,329,067 | B1 | 2/2008 | Rodriguez | |
| 7,581,351 | B2 | 9/2009 | Lewis | |
| 7,641,416 | B2 | 1/2010 | Miracle | |
| 7,862,252 | B2 | 1/2011 | Gelfand | |
| 8,206,056 | B2 * | 6/2012 | O'Banion et al. | 404/6 |
| 2005/0220536 | A1 | 10/2005 | Blair et al. | |
| 2005/0232740 | A1 | 10/2005 | Cummings | |
| 2010/0098486 | A1 | 4/2010 | Miracle | |
| 2011/0042634 | A1 * | 2/2011 | Boychuk | 254/286 |

* cited by examiner

VERTICALLY ACTUATED VEHICLE BARRIER SYSTEM

PRIORITY

This application claims priority to U.S. Provisional Patent Application No. 61/510,194, entitled "Vertically Actuated Vehicle Barrier System," filed Jul. 21, 2011, the disclosure of which is incorporated by reference herein.

BACKGROUND

Versions of the present invention relate to systems and devices that may be used to provide a barrier to prevent the passage of vehicles and the like. Some barriers may be installed in a fixed configuration, such that the barrier system constantly prevents the passage of vehicles and the like. Other barriers may be selectively deployable, such that vehicles may pass during selected times (e.g., when the barrier is present but not deployed); while vehicles may be prevented from passing during other selected times (e.g., when the barrier is deployed). Some vehicle barriers are shown and described in U.S. Pub. No. 2010/0098486, entitled "Vertically Actuated Vehicle Barrier System," published Apr. 22, 2010, the disclosure of which is incorporated by reference herein. Additional vehicle barriers are shown and described in U.S. Pat. No. 7,641,416, entitled "Vehicle Barrier Deployment System," issued Jan. 5, 2010, the disclosure of which is incorporated by reference herein. While a variety of systems and methods have been made and used to provide a barrier, it is believed that no one prior to the inventor has made or used the invention described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
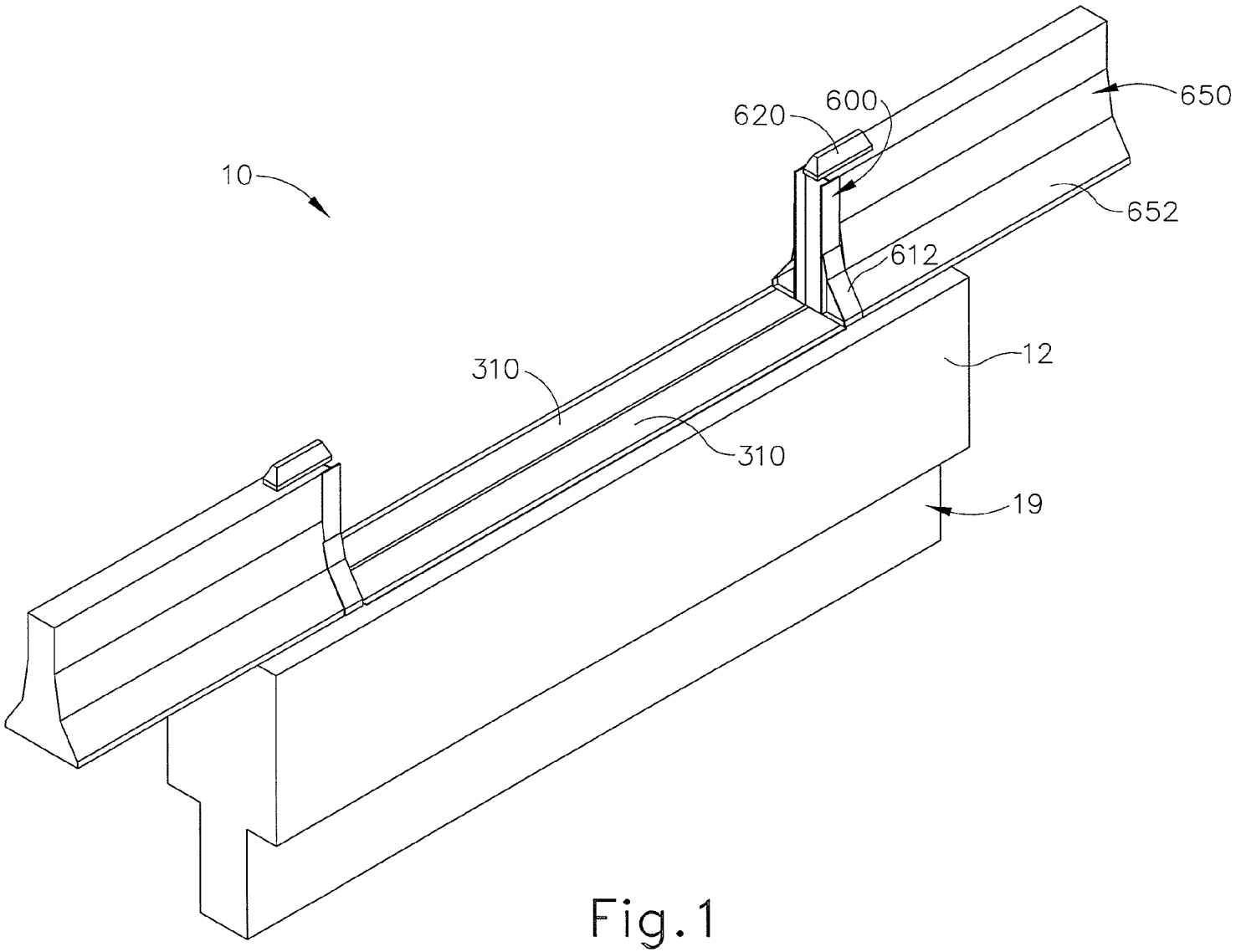
FIG. 1 depicts a perspective view of an exemplary vehicle barrier system in an undeployed position.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown. While some of the drawings include specific dimensions, etc., it should be understood that those dimensions are mere examples. Any other suitable dimensions, proportions, etc., may be used.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

I. Overview of Exemplary Vehicle Barrier with Beams

FIGS. 1-25 show an exemplary vehicle barrier system (10) that includes horizontal gate beams (110, 112) and that is selectively retractable into a vault or housing (20), which is embedded within reinforced concrete (12) in the ground. A plurality of vertical posts (40, 42) are operable to reciprocate relative to housing (20) to selectively raise and lower gate beams (110, 112) relative to housing (20). A pair of hinged cover plates (310) are coupled with housing (20) and are configured to substantially close posts (40, 42) and gate beams (110, 112) within housing (20) when posts (40, 42) and gate beams (110, 112) are retracted downward. Barrier system (10) is shown as being positioned between a pair of barrier walls (650), with static guides (600) being interposed between barrier system (10) and barrier walls (650). A counterweight sprocket cap (620) spans across the top of each static guide (600) and the adjacent barrier wall (650), as will be described in greater detail below.

Posts (40, 42) include passive posts (40) and lifting posts (42), as will be described in greater detail below. Gate beams (110, 112) are coupled with posts (40, 42) via collar assemblies in the present example. Such collar assemblies may be constructed in accordance with the teachings of U.S. Pub. No. 2010/0098486. Alternatively, gate beams (110, 112) may be coupled with posts (40, 42) in any other suitable fashion. It will be appreciated that any suitable number of passive posts (40) and/or lifting posts (42) may be used in any suitable arrangement. In the present example, posts (40, 42) comprise steel I-beams, though it should be understood that any other suitable structures (e.g., steel square tubes, etc.) or combinations of different structures may be used. It should also be understood that posts (40, 42) may be formed of any suitable material(s) and may have any suitable cross sectional form(s). Furthermore, in some versions posts (40) are omitted entirely, such that only posts (42) are included. In some such versions, posts (42) are coupled together via one or more gate beams (110, 112) and/or other components.

As will be described in greater detail below, posts (40, 42) are connected by gate beams (110, 112) and a horizontal member (114) such that posts (40, 42) move vertically substantially simultaneously. In some versions, a single horizontal member (114) spans across all posts (40, 42) (e.g., along the tops of posts (40, 42)), while separate horizontal gate beams (110, 112) span between adjacent posts (40, 42). While barrier system (10) of the present example comprises three beams (110, 112), it should be understood that any other suitable number of beams (110, 112) may be used. It should also be understood that various structures other than beams (110, 112) may be used. Several structures that may be used as an alternative to horizontal gate beams (110, 112) are described elsewhere herein, while others will be apparent to those of ordinary skill in the art in view of the teachings herein.

Figure 2:
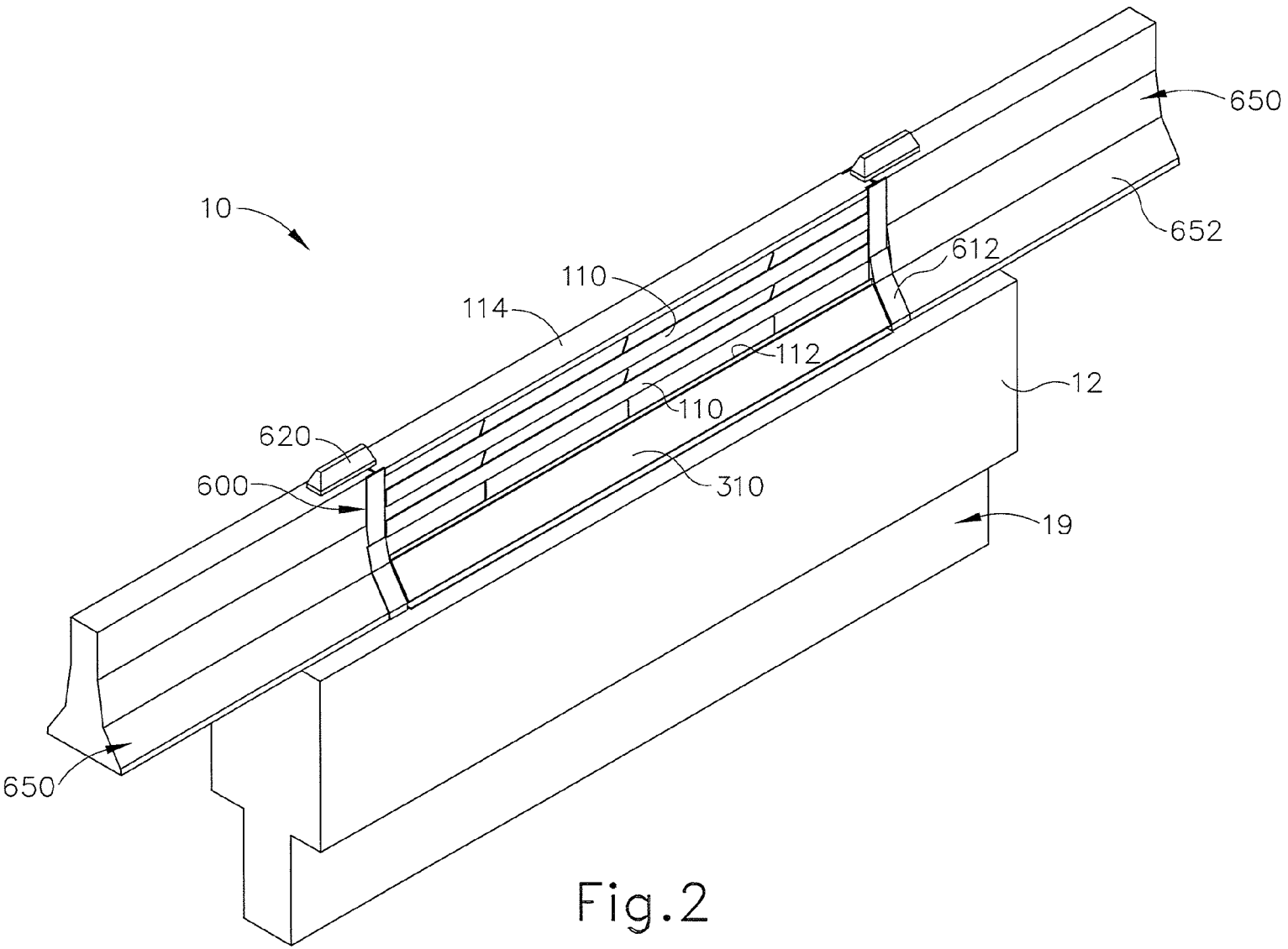
FIG. 2 depicts a perspective view of the system of FIG. 1 in a deployed position.
Figure 3:
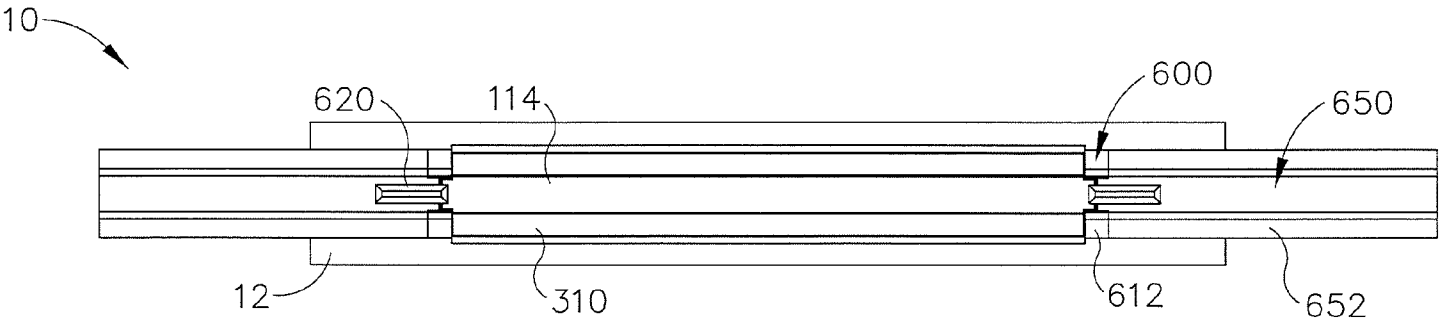
FIG. 3 depicts a top plan view of the system of FIG. 1.
Figure 4:
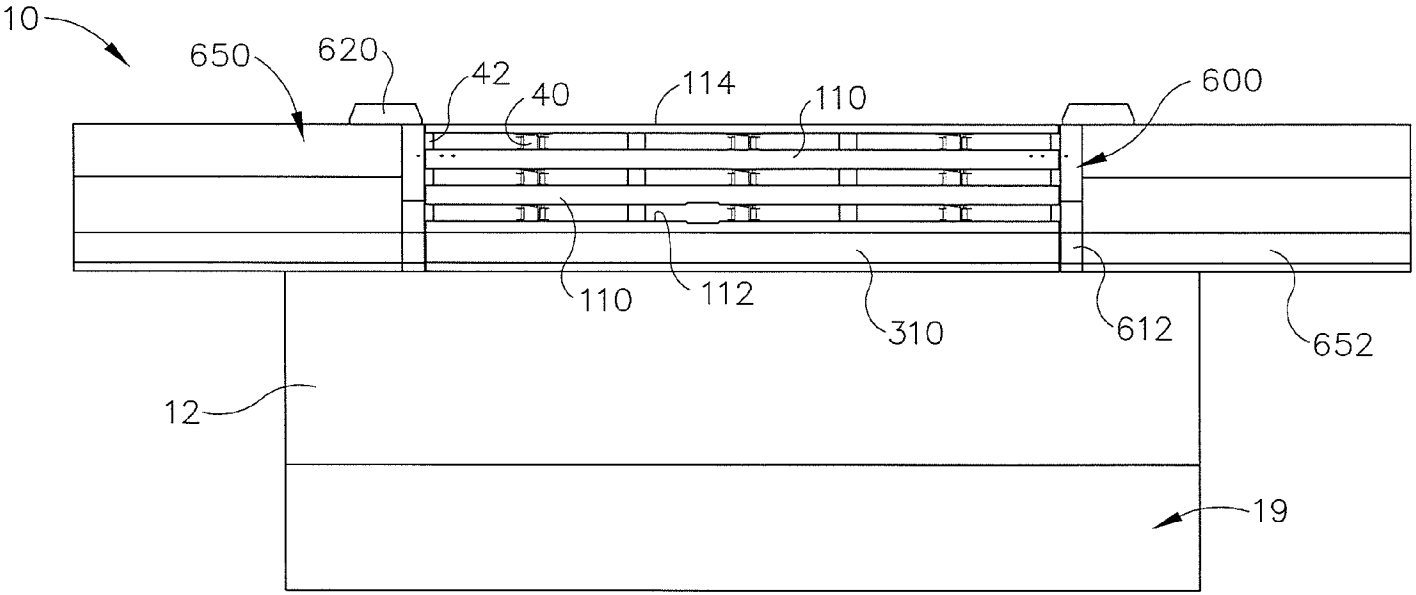
FIG. 4 depicts a front elevation view of the system of FIG. 1.
Figure 5:
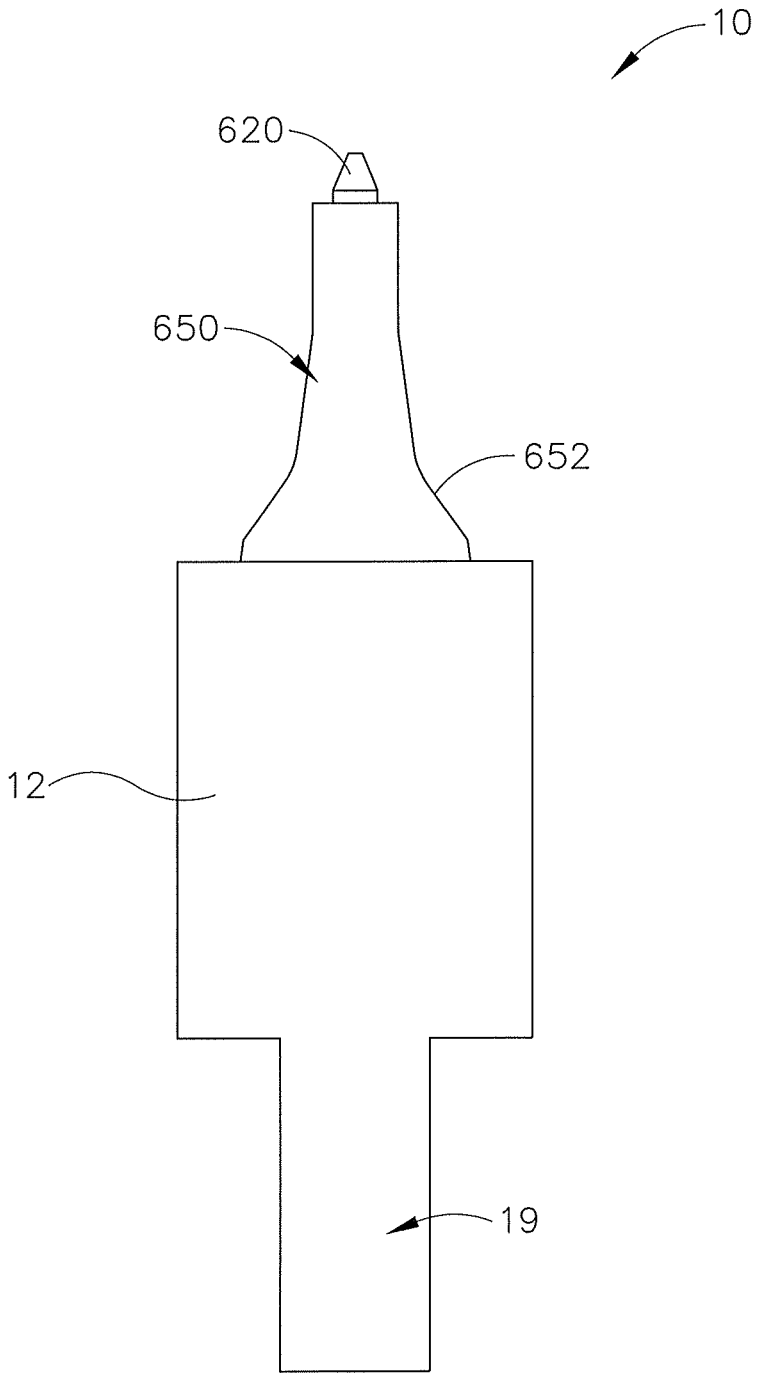
FIG. 5 depicts an end view of the system of FIG. 1.

FIG. 2 shows posts (40, 42) and gate beams (110, 112) in a deployed configuration, with cover plates (310) open. In this configuration, posts (40, 42) and gate beams (110, 112) are substantially positioned above ground level, and are configured to provide a barrier against passage of vehicles and the like. Barrier system (10) may therefore be provided within a road, median, sidewalk, or elsewhere to selectively prevent passage of vehicles and the like. Various suitable locations and ways in which barrier system (10) may be positioned and used will be described in greater detail below, while other suitable locations and ways in which barrier system (10) may be positioned and used will be apparent to those of ordinary skill in the art in view of the teachings herein.

In some versions, barrier system (10) may stop a vehicle that is traveling at a high rate of speed, even if the driver of the vehicle is intent on passing through the barrier provided by barrier system (10). For instance, posts (40, 42) and gate beams (110, 112) may be sufficiently anchored such that they provide little or no "give" when struck by a vehicle (e.g., a car or truck, etc.). By way of example only, some versions of barrier system (10) may meet a Department of State "K" certification requiring that the front line of cargo of a 15,000 pound vehicle traveling 50 mph must not go further than 1 meter past the line defined by barrier system (10). In addition or in the alternative, some versions of barrier system (10) may satisfy the American Association of State Highway and Transportation Officials (AASHTO) Manual for Assessing Safety Hardware (MASH) criteria. In some instances with some versions of barrier system (10), posts (40, 42) and/or gate beams (110, 112) may essentially destroy a vehicle that strikes posts (40, 42) and/or gate beams (110, 112), with relatively little damage being done to barrier system (10). For instance, barrier system (10) may be constructed such that no portions of barrier system (10) are released as projectiles when barrier system (10) is struck by a heavy vehicle moving at a high rate of speed.

Figure 29:
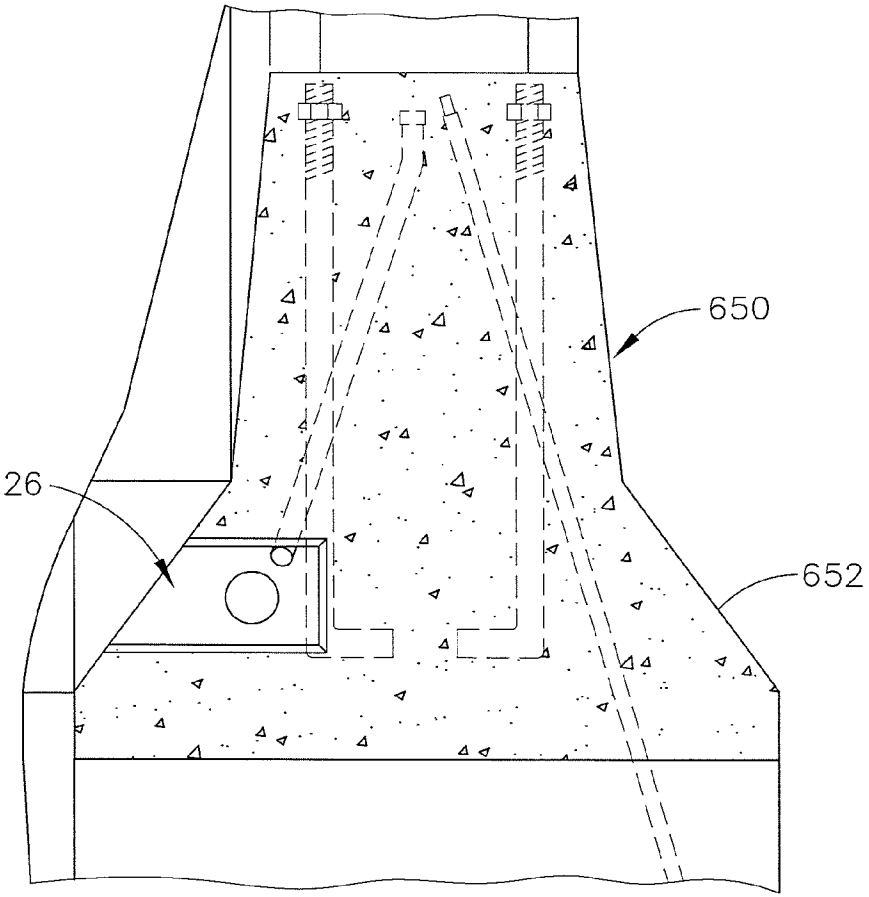
FIG. 29 depicts a cross-sectional end view of an exemplary electrical component compartment in a barrier wall.

As shown in FIGS. 6-9, housing (20) of the present example comprises sidewalls (22) and a floor (24). A plurality of electrical components may be provided within a compartment (26) of housing (20), within barrier wall (650), and/or elsewhere. A merely illustrative example of how compartment (26) (or at least some electrical components) may be incorporated into barrier wall (650) are shown in FIG. 29. Other suitable locations and structures in which electrical components may be provided will be apparent to those of ordinary skill in the art in view of the teachings herein. Such electrical components may include, among other things, an electrical junction box, a transformer, a DC/AC inverter, a battery, a battery charger, and/or a limit switch (not shown). Of course, each and every one of these components is merely optional, and any of them may be varied, substituted, supplemented, or omitted as desired. In the present example, these components provide electricity to other components within housing (20), as will be described in greater detail below. Various ways in which these components may be selected and coupled will be apparent to those of ordinary skill in the art in view of the teachings herein.

It should be understood that compartment (26) may be provided at either or both ends of housing (20), in addition to or in lieu of being incorporated into barrier wall (650). Alternatively, compartment (26) may be provided at any other suitable location; or may be omitted altogether (e.g., components separated and located at various positions within housing (20), etc.). By way of example only, one or more batteries (43) may be mounted to gate beam (112). In some versions, battery (43) is rechargeable by solar power via a solar panel (not shown). In some other versions, a battery is omitted, and an external power line is fed to housing (20). It will be appreciated, therefore, that a variety of alternative components may be used to provide and/or regulate electricity to other components within housing (20). It will also be appreciated that, in some versions, barrier system (10) may be modified such that no external power source is required at all. A sump pump may also be provided within housing (20), below housing (20), or elsewhere, such as to purge water from housing (20). For instance, a perforated drainage pipe or "French drain" may be located at the bottom of housing (20) (e.g., below floor (24)), and may be coupled with a sump pump. Of course, as with various other components described herein, a sump pump is merely optional. Housing (20) may also be structurally reinforced in various ways, including but not limited to using any of the reinforcement structures described in U.S. Pat. No. 7,641,416 and/or U.S. Pub. No. 2010/0098486, the disclosures of which are incorporated by reference herein.

Figure 6:
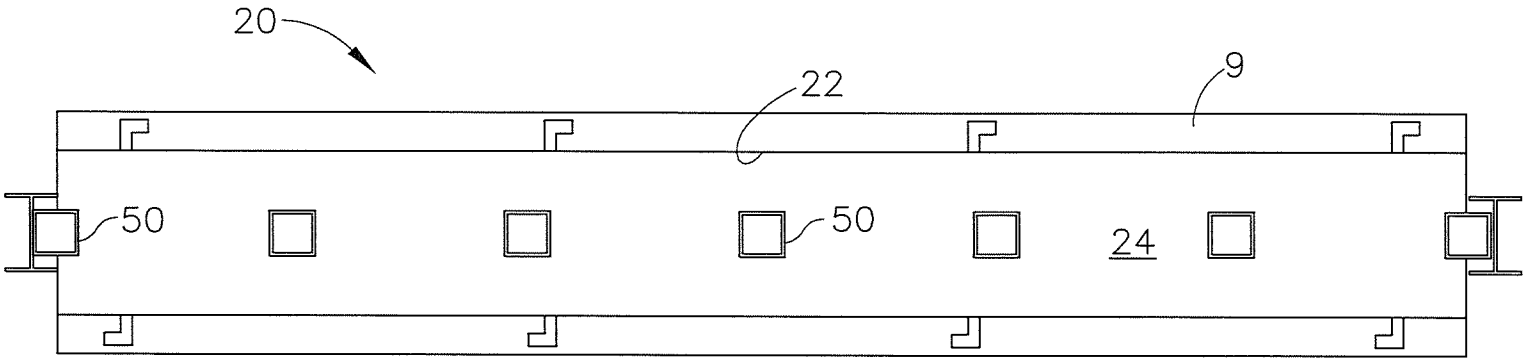
FIG. 6 depicts a top plan view of a vault portion of the system of FIG. 1.
Figure 7:
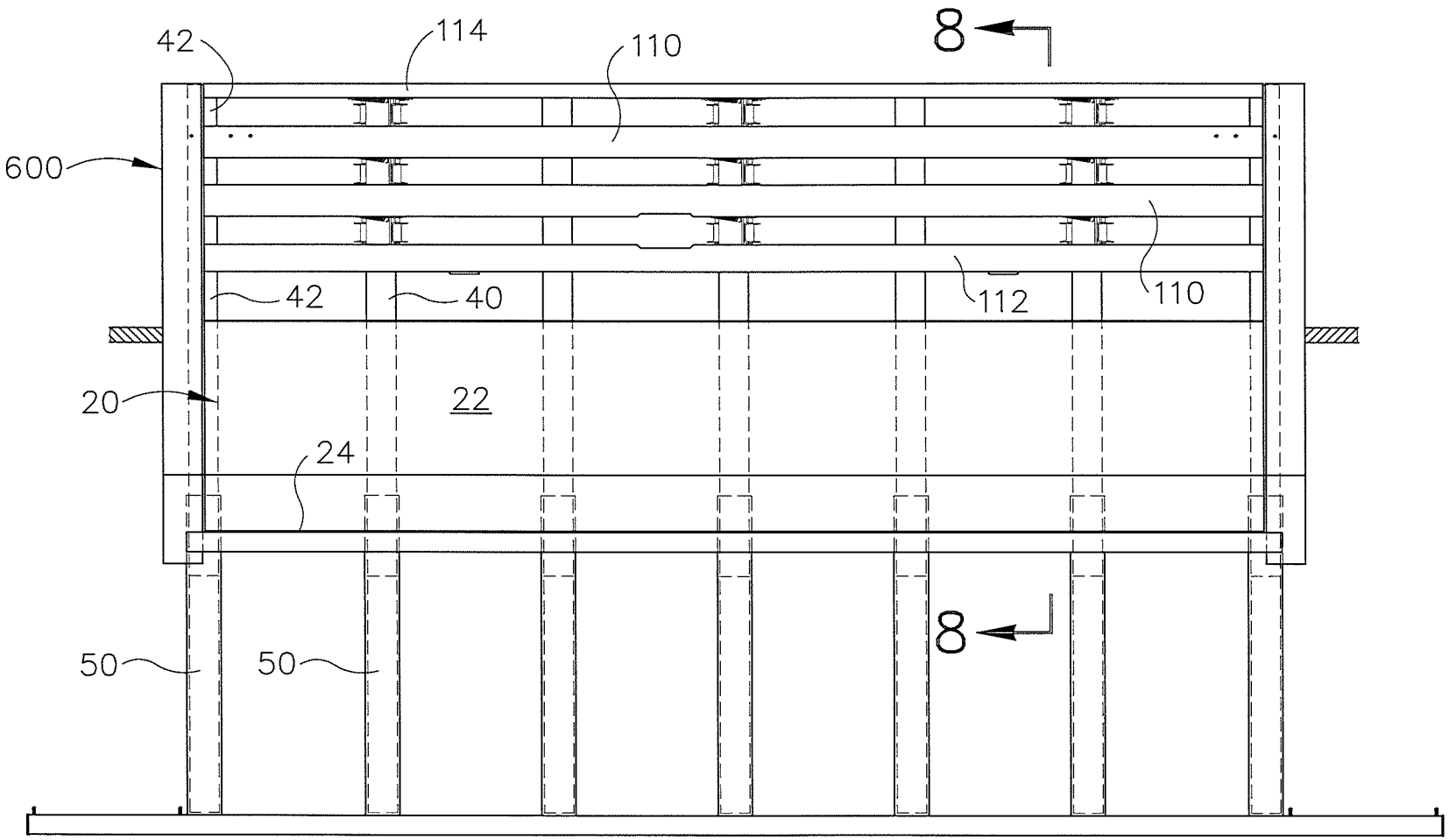
FIG. 7 depicts a front elevation view of a vault portion of FIG. 6.

As shown in FIGS. 6-9, a plurality of post guides (50) extend upwardly from floor (24) of housing (20). In some versions, at least a portion of each post guide (50) is hingedly coupled with housing (20). For instance, such a hinged coupling may allow the hinged portions of post guides (50) to be folded over to reduce the overall height of barrier system (10) when barrier system (10) is transported from one location to another location. With reference to FIG. 6, outermost post guides (50) are positioned in notches at the outer ends of housing (20); while interior post guides (50) are positioned in openings formed through floor (24) of housing (20). Post guides (50) of the present example comprise steel tubes having a square cross section. In some versions, reinforced concrete (12) is formed to itself provide/define post guides (50) and/or drainage system features as described elsewhere herein. Alternatively, post guides (50) may be formed of any other suitable material(s) and may have any other suitable cross section. In the present example, outermost post guides (50) are also engaged with static guides (600), such as by being welded to an associated static guide (600).

Figure 8:
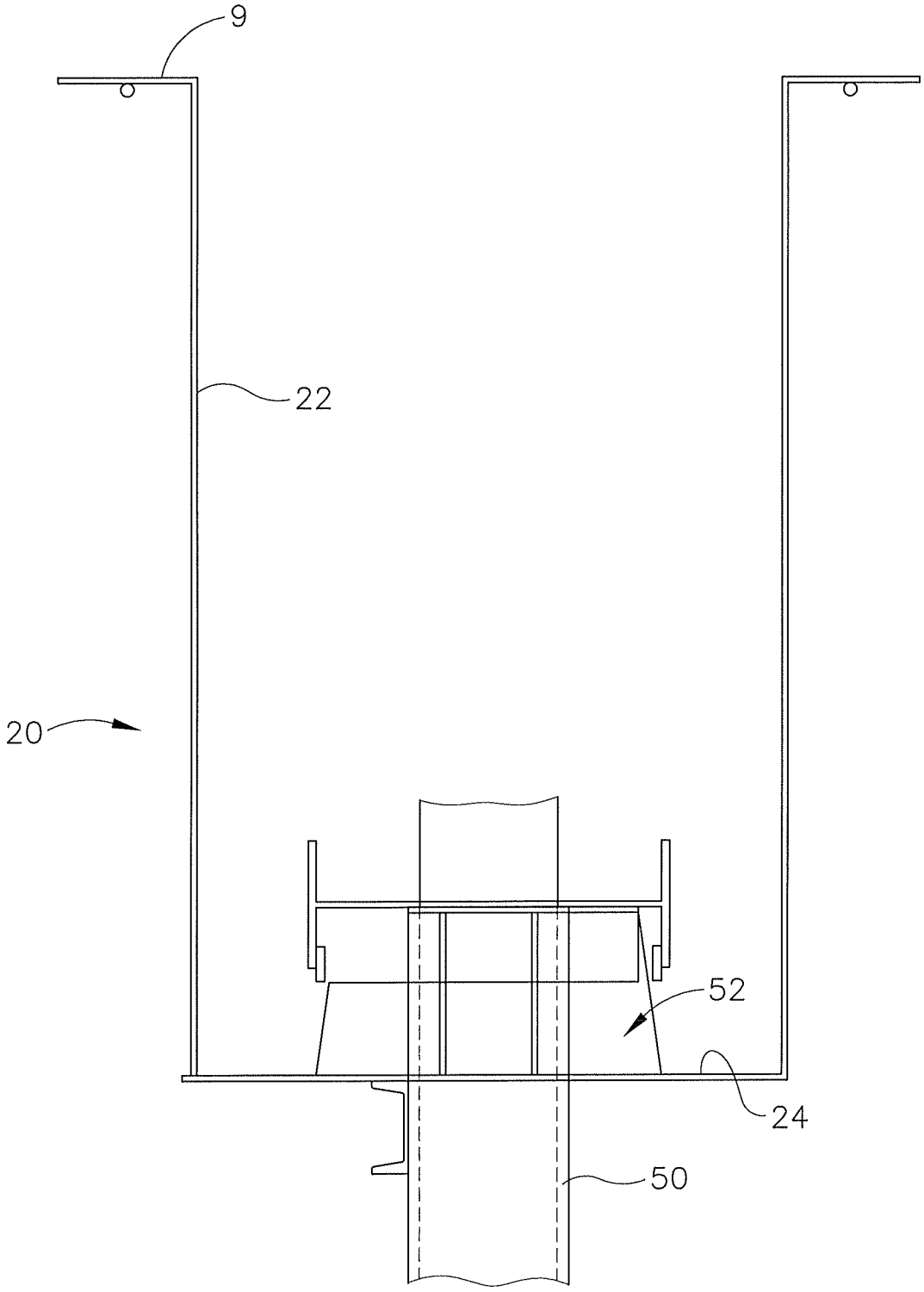
FIG. 8 depicts a cross-sectional end view of the vault portion of FIG. 6, taken along line 8-8 of FIG. 7.
Figure 9:
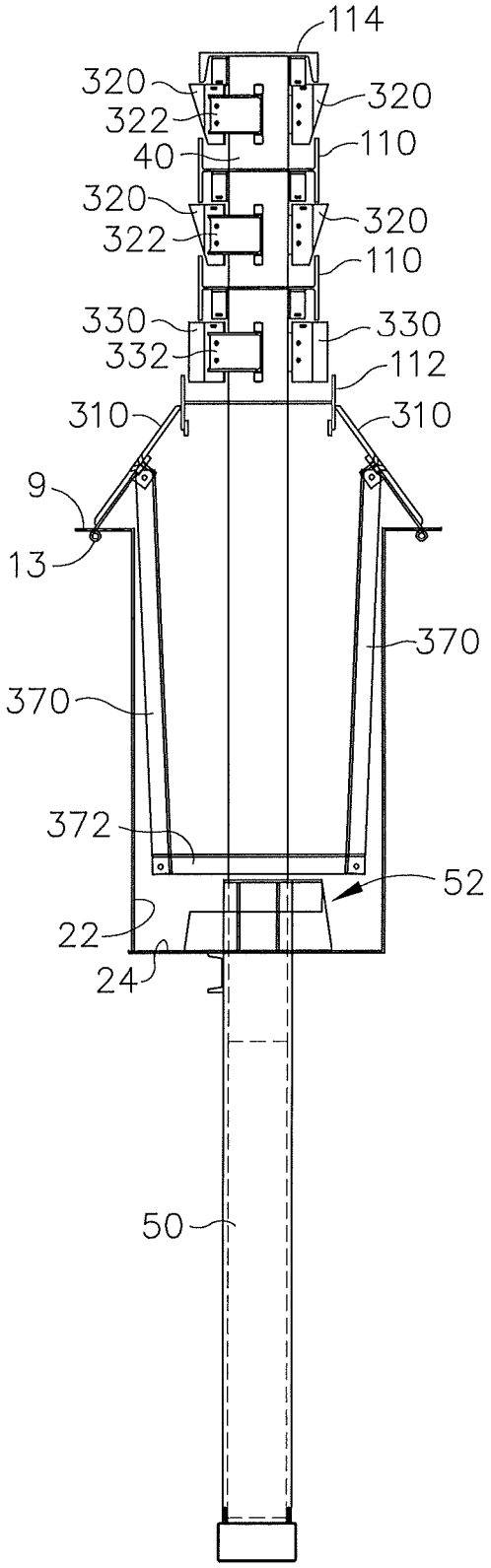
FIG. 9 depicts another cross-sectional end view of the vault portion of FIG. 6, including part of the barrier and a cover closing assembly.

As shown in FIGS. 8-9, each post guide (50) includes a reinforcement collar (52) about the part of the post guide (50) that protrudes upwardly from floor (24) of housing (20). Such collars (52) may be configured in accordance with the teachings of U.S. Pub. No. 2010/0098486 and/or otherwise. Of course, reinforcement collars (52) may be joined with post guides (50) and/or floor (24) in any other suitable fashion using any other suitable types of devices, components, features, or techniques. Optionally, post guides (50) may include "I-beams" or other suitable structures secured within their interior for reinforcement.

Post guides (50) are configured to slidably receive posts (40, 42). In particular, posts (40) are inserted in interior post guides (50); while posts (42) are inserted into outermost post guides (50). Post guides (50) are configured to restrict lateral movement of posts (40, 42), while permitting posts (40, 42) to move vertically (e.g., reciprocate) within post guides (50). While five posts (40) and two posts (42) are shown in the present example, it should be understood that any desired number of posts (40, 42) may be used. Likewise, any suitable number of post guides (50) may be used. It should also be understood that one or more shim plates and/or other components/features may be used to regulate the space between the exterior of a post (42) and the adjacent surface of static guide (600). Similarly, one or more shim plates and/or other components/features may be used to regulate the space between the exterior of posts (40, 42) and post guides (50). For instance, shim plates may be placed at different vertical heights along each post (40, 42). Some examples of such uses of shim plates are described in U.S. Pub. No. 2010/0098486, while other examples will be apparent to those of ordinary skill in the art in view of the teachings herein. As yet another merely illustrative example, posts (42) and/or static guides (600) may include freely rotating rollers, rub plates (e.g., formed of ultra high molecular weight material, etc.), and/or various other structures to facilitate vertical movement of posts (42) relative to static guides (600).

Post guides (50) may have a height that is greater than the height of sidewalls (22), though post guides (50) do not extend above sidewalls (22) in this example. For instance, while the upper rims of post guides (50) may be positioned below the upper rims of sidewalls (22), the lower portions of post guides (50) may extend below floor (24) of housing (20). In particular, the lower portions of post guides (50) may be embedded in concrete (12) or in the ground, below floor (24). FIGS. 1-2 and 4-5 show a lower portion (19) of concrete (12) that encases post guides (50). Alternatively, post guides (50) may have any other desired length and position relative to housing (20). In addition, the lower end of each post guide (50) may communicate with a drainage system, as described in U.S. Pub. No. 2010/0098486 or otherwise. Of course, a variety of other types of drainage systems may be provided; or barrier system (10) may even lack a drainage system.

As noted above, a pair of static guides (600) are positioned outside of housing (20), on opposite ends of housing (20). Static guides (600) of the present example comprise steel I-beams having flanges that extend transversely from a central web member. The lower ends of static guides (600) extend through concrete (12), below floor (24) of housing (20), such that the lower ends of static guides (600) are encased in concrete (12); while the upper ends of static guides (600) protrude above the ground. In the present example, a portion of the upper end each static guide (600) is attached with an adjacent concrete barrier wall (650) (e.g., a "Jersey Barrier" wall), such that the concrete barrier wall (650) is inserted between opposing flanges and abuts the central web member of static guide (600). Static guide (600) may thus act as a cap piece for the end of barrier wall (650). For instance, when barrier system (10) is installed in a gap between preexisting concrete barrier walls (650), upper ends of static guides (600) may be bolted to or otherwise secured to adjacent such preexisting concrete barrier walls (650) (e.g., a bolt inserted through opposing flanges (602) and through concrete barrier wall (650), etc.). As another merely illustrative example, when barrier system (10) is installed with new adjacent concrete barrier walls (650), the new concrete barrier walls (650) may be formed around or adjacent to static guides (600) such that static guides (600) are embedded in the new concrete barrier walls (650). Still other suitable ways in which the upper portions of static guides (600) may be laterally restrained will be apparent to those of ordinary skill in the art in view of the teachings herein.

As best seen in FIGS. 1-2, each static guide (600) of the present example includes a pair of foot portions (612). In particular, foot portions (612) extend outwardly from the outer faces of the flanges of static guide (600). Foot portions (612) have a profile configured to mimic the profile of foot portion (652) of concrete barrier (650). Foot portions (612, 652) thus provide a substantially smooth transition from concrete barrier (650) to static guide (600). In some versions, foot portions (612) include beveled edges and/or other structural features that are configured to avoid snow plow blades or the like getting snagged on foot portions (612). Of course, as with other components described herein, foot portions (612) are merely optional, and static guides (600) may have a variety of alternative components, features, and configurations. As best seen in FIG. 9, the lowermost gate beam (112) of the present example is wider than the rest of the gate beams (110). This configuration and arrangement provides a profile collectively presented by gate beams (110, 112) and cover plates (310) that substantially mimics the profile of concrete barrier (650). Thus, static guides (600) and barrier system (10) both present a profile that is substantially similar to the profile of concrete barrier (650). Again though, any other suitable sizes, arrangements, and configurations may be used. For instance, some versions of barrier system (10) may include gate beams (110, 112) that all have approximately the same width.

Figure 30:
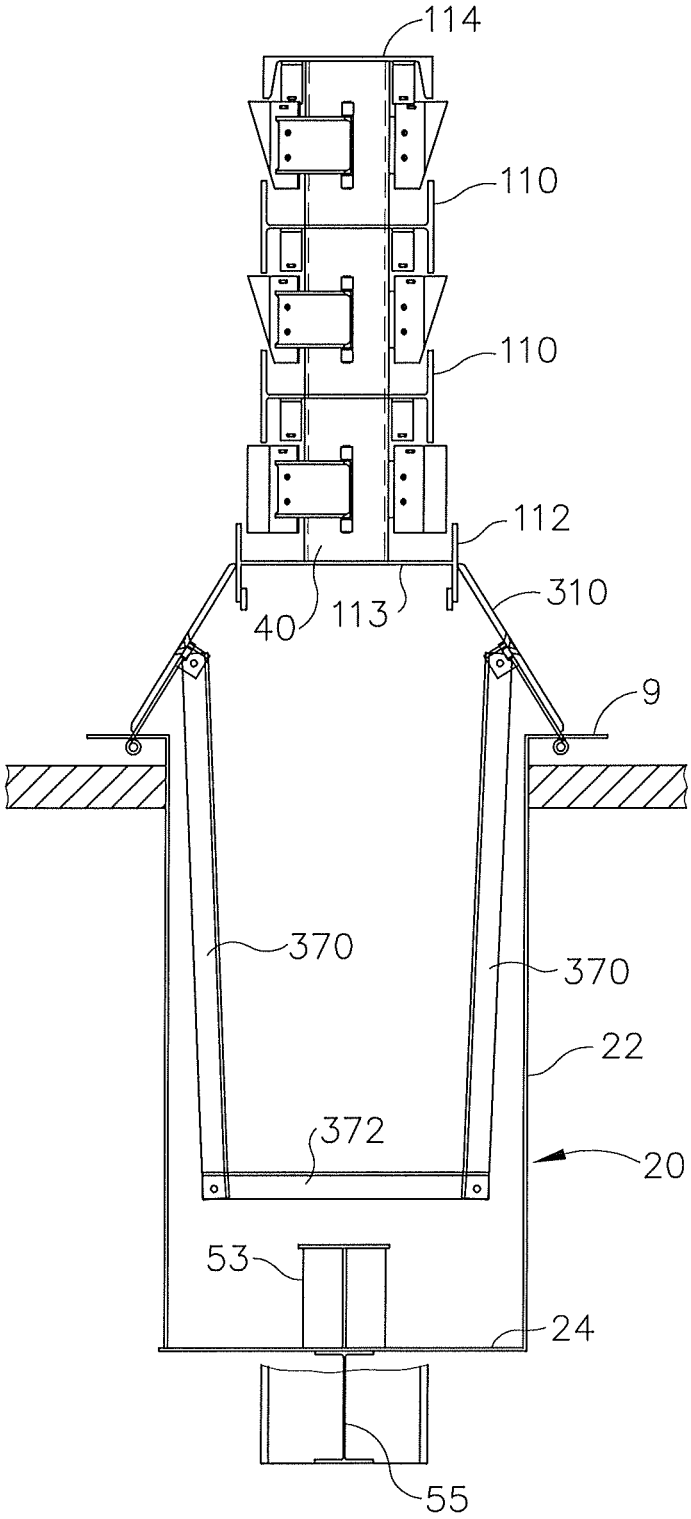
FIG. 30 depicts a cross-sectional end view of an exemplary alternative form that the features shown in FIG. 9 may take.

FIG. 30 shows one merely illustrative variation of the components described above. In particular, post guides (50) and lower portion (19) of concrete (12) are completely omitted in this version. In addition, posts (40, 42) are shortened such that they terminate at central web member (113) of gate beam (112). A plurality of upper footers (53) are secured to floor (24) of housing (20) in a spaced apart fashion, in the same locations where post guides (50) are shown in FIG. 6. Upper footers (53) comprise I-beam segments in the present example, though it should be understood that any other suitable structures may be used. In some variations, a single footer (53) is used. Such a single footer may extend the full length of housing (20), and its ends may be further secured to static guides (600).

Continuing with the example shown in FIG. 30, a lower footer (55) is positioned underneath floor (24), further underneath upper footers (53). Lower footer (55) also comprises an I-beam in this example, though again any other suitable structures may be used. In some versions, lower footer (55) extends along the full length of housing (20). In some other versions, lower footer (55) comprises a plurality of discrete segments corresponding to the segments forming upper footers (53). It should be understood that the variation of barrier system (10) shown in FIG. 30 may function identically to the exemplary version of barrier system (10) described below. In other words, in some versions of the variation of barrier system (10) shown in FIG. 30, the absence of post guides (50) and lower portion (19), and the shortening of posts (40, 42) will not impact performance or functionality; and will not otherwise require any changes to any other components of barrier system (10). Furthermore, the absence of post guides (50) and lower portion (19) may significantly reduce the size, cost, installation time, and/or excavation depth for barrier system (10).

It should be understood that any of the components described above may be modified, substituted, supplemented, relocated, or omitted in any suitable fashion as desired.

II. Exemplary Deployment and Retraction System

A. Exemplary Drive System

In the present example, barrier system (10) is selectively actuated from a retracted configuration (FIG. 1) to a deployed configuration (FIG. 2) by a system that includes a winch (200), a series of sprockets (210, 212, 214, 216, 218, 220, 224, 226, 228), drive shafts (230, 232, 234), and roller chains (240, 242, 244). These components are shown in FIGS. 10-16. It should be understood that lowermost gate beam (112) is shown in cross-section (the cross-section being taken along a vertical plane) in FIGS. 10-11 in order to improve the view of certain components. In the present example, each sprocket (210, 212, 214, 216, 218, 220, 224, 226, 228) includes oil impregnated bushings to facilitate rotation, though it should be understood that this is merely optional. Winch (200) is fixedly mounted to and above central web member (113) of lowermost gate beam (112) in the present example, though it should be understood that winch (200) may alternatively be located elsewhere. Main drive shaft (230) is also mounted to central web member (113) of lowermost gate beam (112) in the present example. In particular, a plurality of bearing assemblies (222) are used to mount main drive shaft (230) to gate beam (112), providing support for main drive shaft (230) while facilitating rotation of drive shaft (230) relative to gate beam (112). Main drive shaft (230) extends along nearly the entire length of gate beam (112) in the present example, though it should be understood that any other suitable length may be used. As best seen in FIG. 13, winch (200) includes a first drive sprocket (210), which is mounted to the drum of winch (200). First drive sprocket (210) is coupled to a first driven sprocket (212) of main drive shaft (230) via a roller chain (240). Thus, winch (200) rotates main drive shaft (230) via sprockets (210, 212) and roller chain (240) when winch (200) is activated. In the present example, central web member (113) of lowermost gate beam (112) defines a slot that provides clearance for passage and free movement of roller chain (240).

Figure 11:
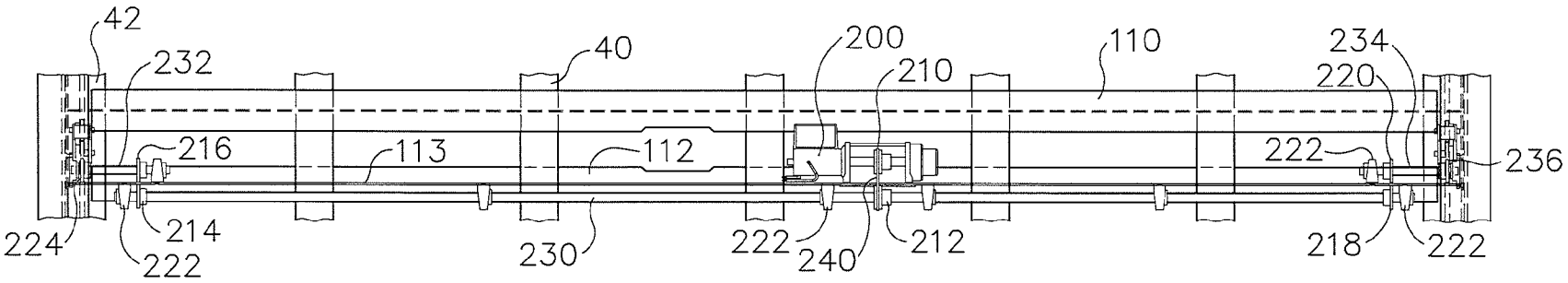
FIG. 11 depicts an elevational view of the drive system of FIG. 10.
Figure 14:
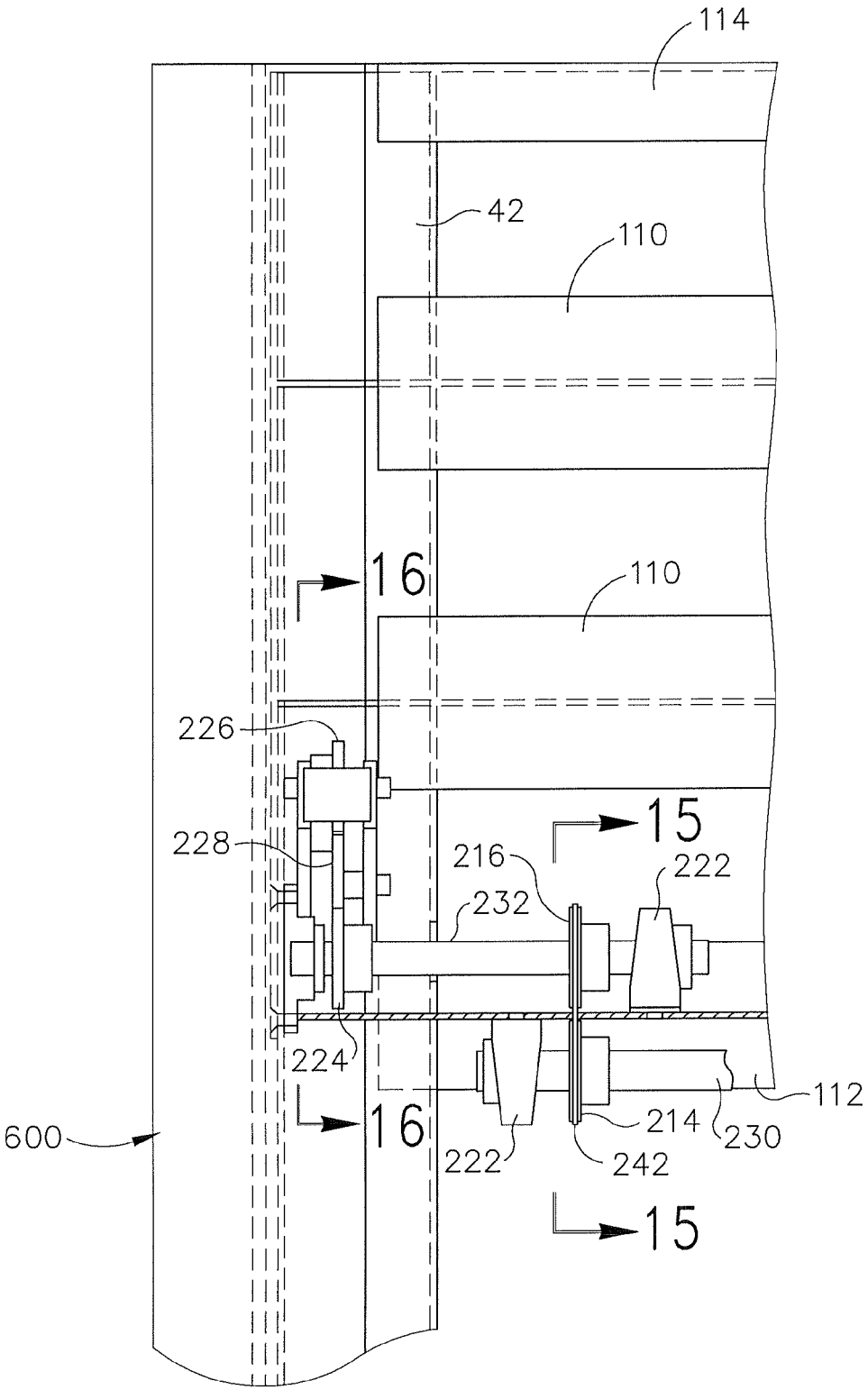
FIG. 14 depicts a partial elevational view of components of the drive system of FIG. 10, at a first longitudinal end of the system of FIG. 1.
Figure 15:
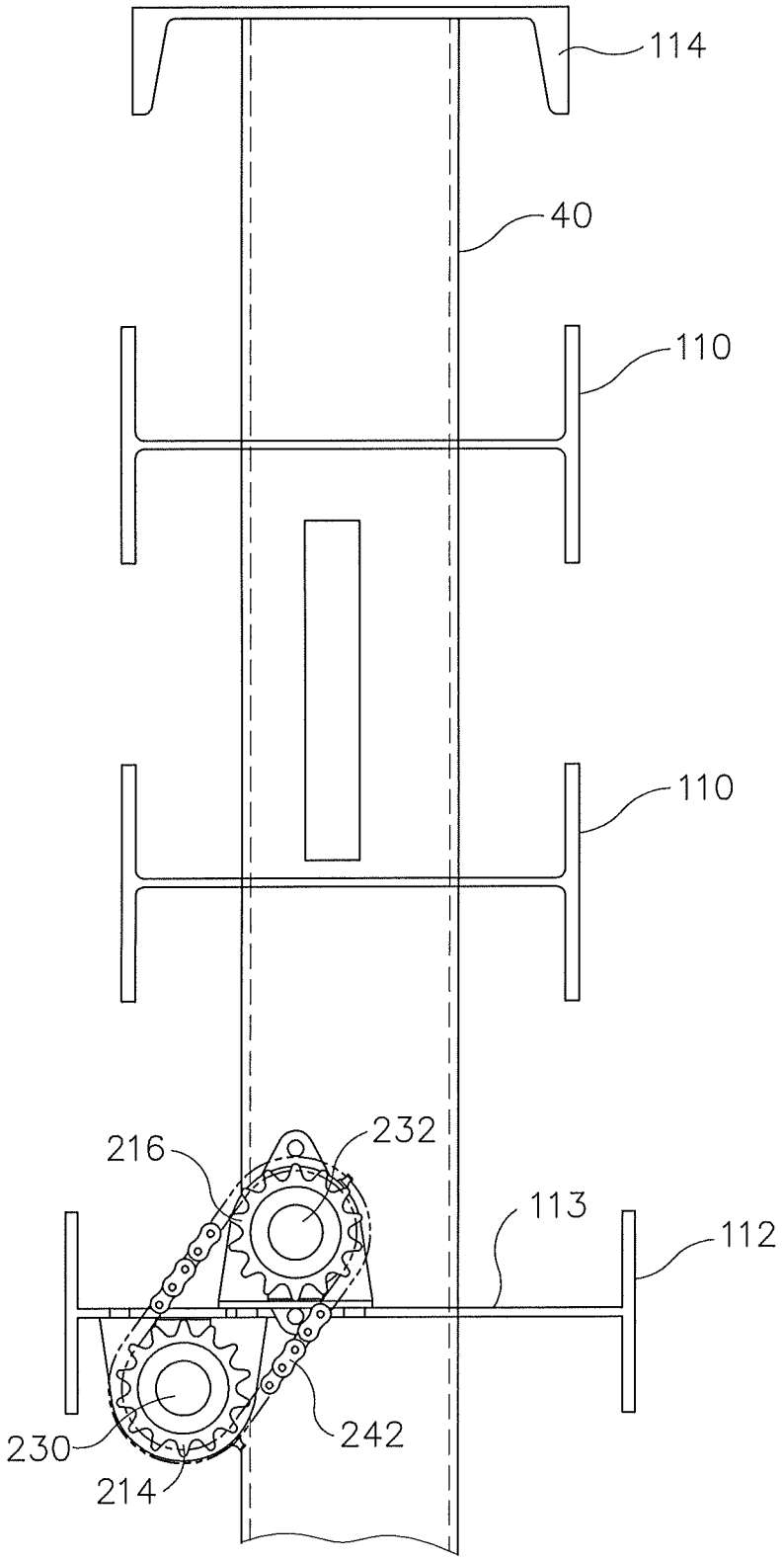
FIG. 15 depicts a partial end view of components of the drive system of FIG. 10, including a shaft driving chain but omitting a lifting chain, from a cross-section taken along line 15-15 of FIG. 14.

As best seen in FIG. 11, a second drive sprocket (214) is provided at one end of main drive shaft (230) while a third drive sprocket (218) is provided at the other end of main drive shaft (230). Second drive sprocket (214) is coupled with a second driven sprocket (216) via a roller chain (242) (see FIGS. 14-15). Similarly, third drive sprocket (218) is coupled with a third driven sprocket (220) via a roller chain (not shown). Second driven sprocket (216) is coupled with a second drive shaft (232), which also includes an end sprocket (224). Similarly, third drive sprocket (218) is coupled with a third drive shaft (234), which includes an end sprocket (236). Drive shafts (232, 234) are secured to gate beam (112) via bearing assemblies (222) in the present example, providing support for drive shafts (232, 234) while allowing drive shafts (232, 234) to rotate relative to gate beam (112). In particular, as best seen in FIG. 14, drive shafts (232, 234) are secured above the central web member (113) of gate beam (112) while main drive shaft (230) is secured below central web member (113) of gate beam (112). It should be understood that slots may be formed in central web member (113) in order to provide free passage of roller chains (242) through central web member (113). Of course, any other suitable components, configurations, and arrangements may be used. The following discussion will focus mainly on the components at the end of barrier system (10) where second drive shaft (232) is located. It should be understood that the components at the other end of barrier system (10) (i.e., the end where third drive shaft (234) is located) are substantially identical in operation and arrangement in the present example.

Figure 10:
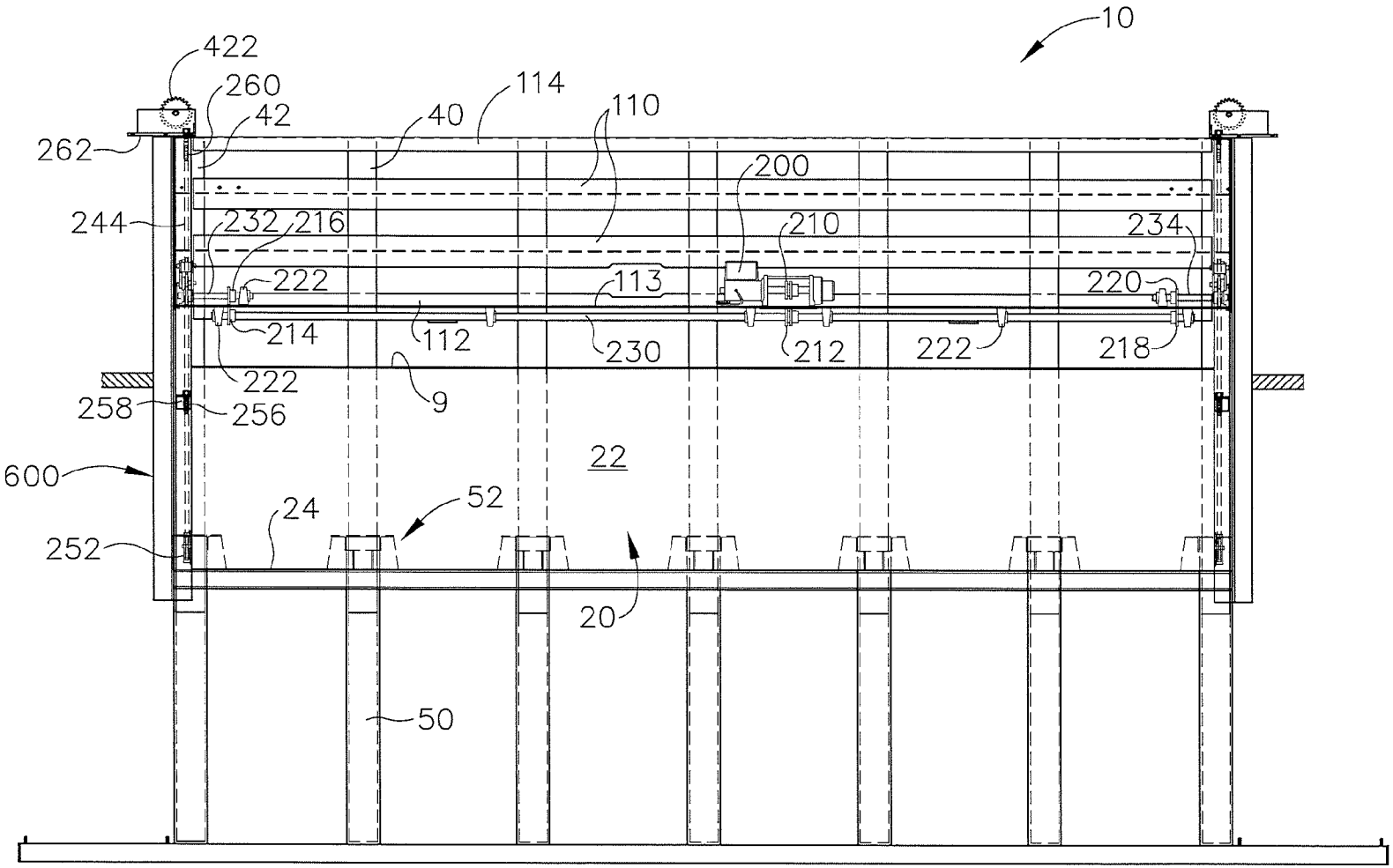
FIG. 10 depicts a front elevation view of the system of FIG. 1, showing components of an exemplary drive system.
Figure 12:
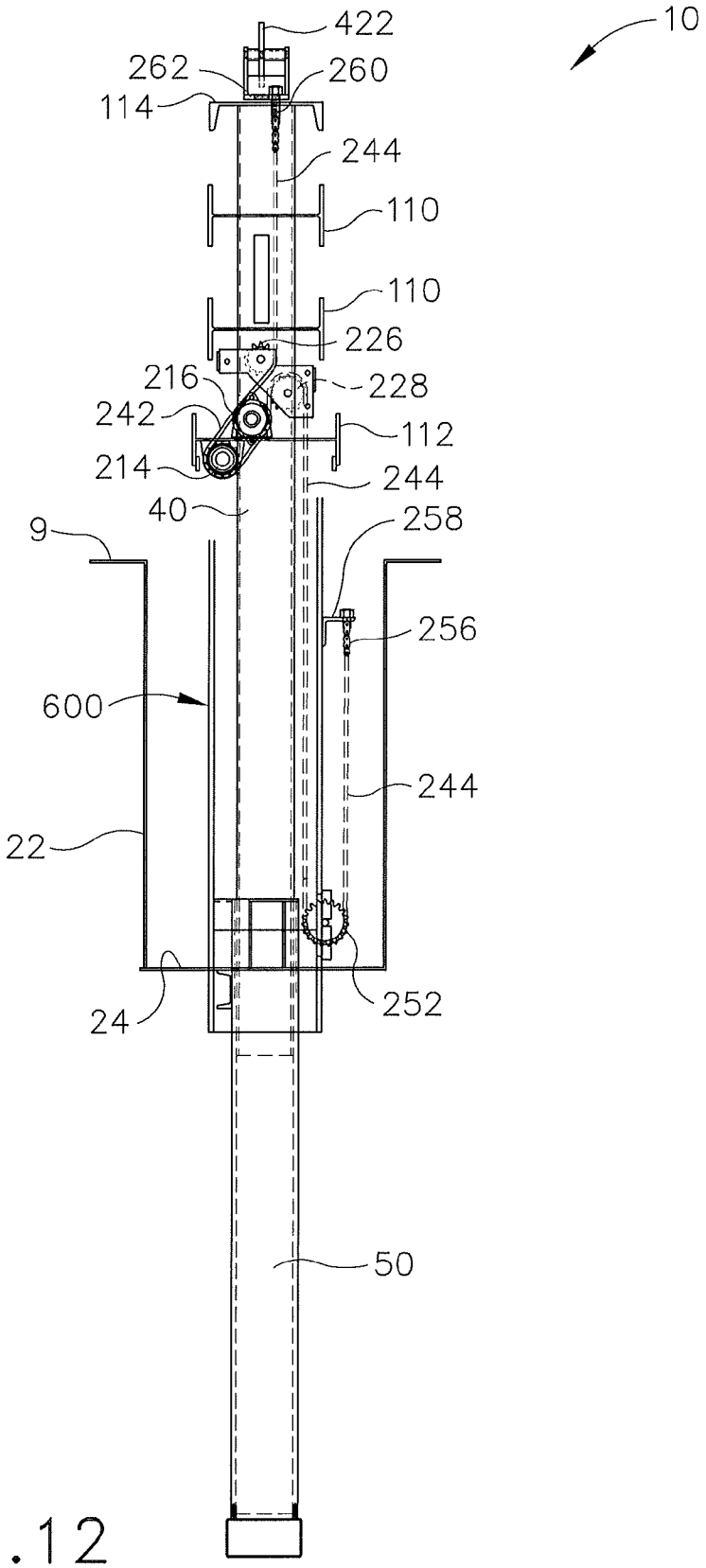
FIG. 12 depicts a cross-sectional end view of the drive system of FIG. 10.
Figure 13:
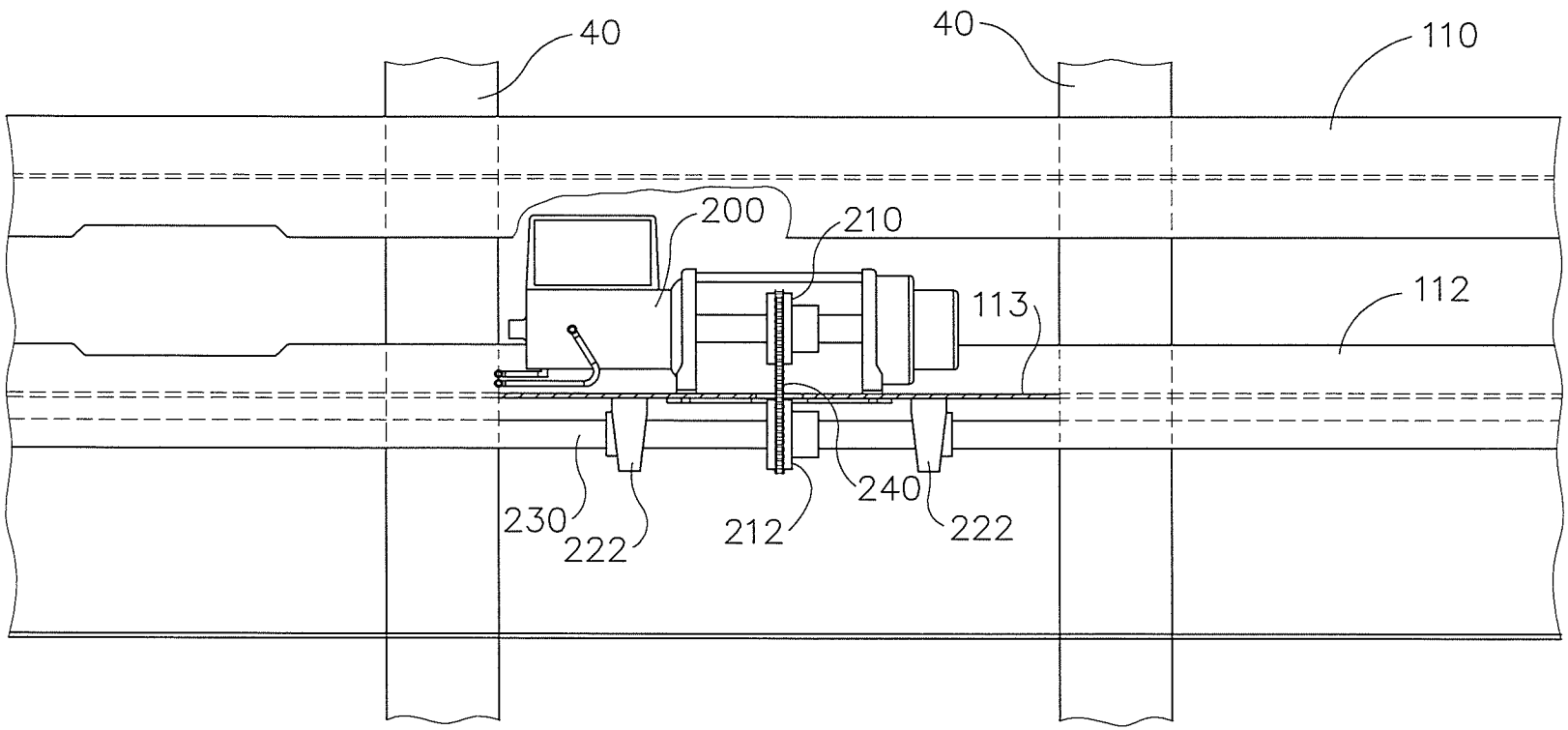
FIG. 13 depicts a partial elevational view of some of the components of the drive system of FIG. 10, within a longitudinally central region of the system of FIG. 1.
Figure 16:
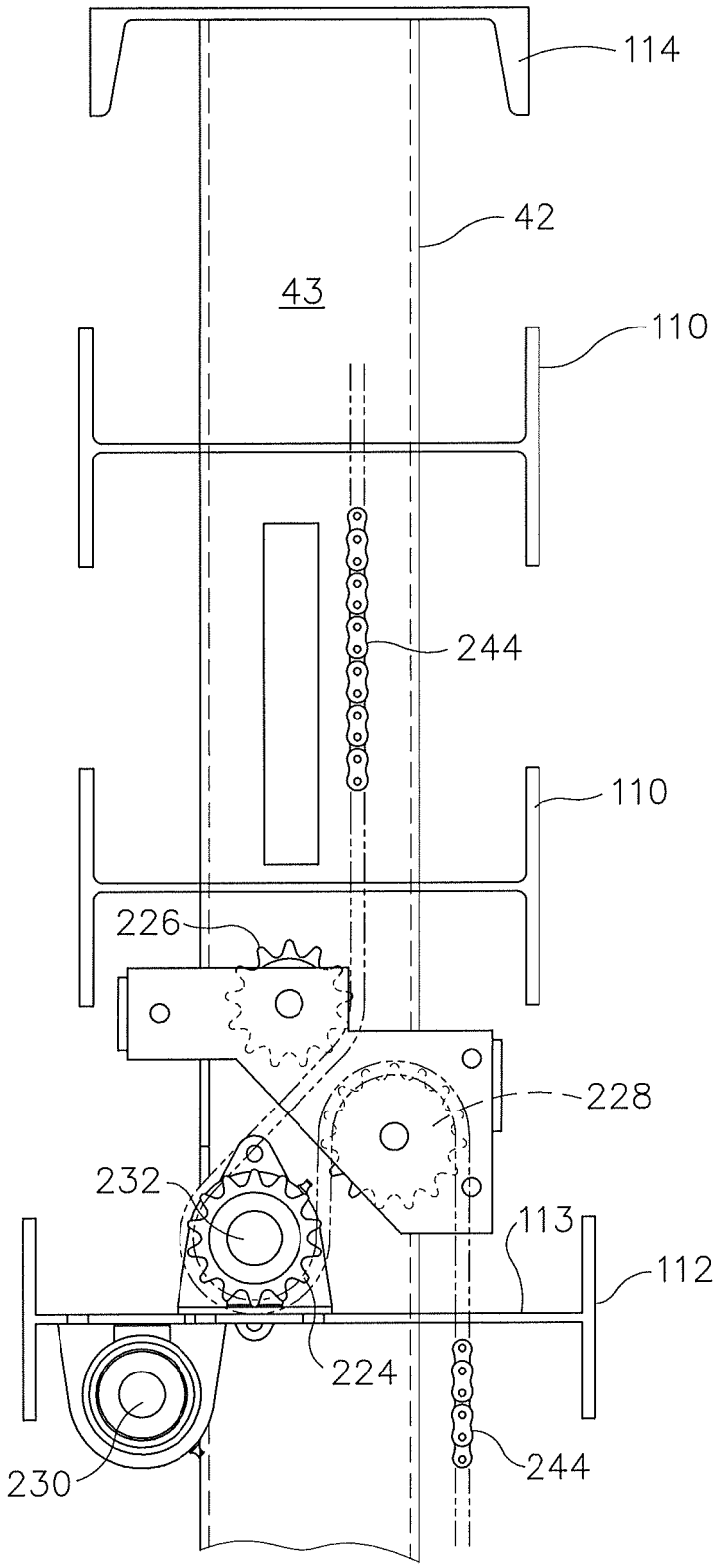
FIG. 16 depicts a partial end view of components of the drive system of FIG. 10, including a lifting chain but omitting a shaft driving chain, from a cross-section taken along line 16-16 of FIG. 14.

As best seen in FIGS. 12 and 16, a lifting roller chain (244) is engaged with end sprocket (224). Lifting roller chain (244) is also engaged with a pair of idler sprockets (226, 228), which are mounted to a central web portion (43) of post (42). Sprockets (224, 226, 228) are all mounted such that sprockets (224, 226, 228) are all positioned along a common vertical plane. FIG. 16 best shows the routing of lifting roller chain (244) around sprockets (224, 226, 228). One end of lifting roller chain (244) is secured to a bolt (260), which is adjustably secured to a plate (262). Plate (262) is fixedly secured to the top of static guide (600), as shown in FIGS. 10 and 12. In the present example horizontal member (114) includes a notch (not shown) that is configured to provide clearance for lifting roller chain (244) and bolt (260) as barrier (10) is raised to the deployed position.

As best seen in FIG. 12, the other end of lifting roller chain (244) passes around a redirector sprocket (252), which redirects roller chain (244) approximately 180°, to reach a bolt (256). Roller chain (244) is fixedly secured to bolt (256). Bolt (256) is adjustably secured to a bracket (258), which is fixedly secured to a bottom region of static guide (600). It should be understood that the effective length or tension in lifting roller chain (244) may be adjusted by selectively adjusting the position of bolt (260) relative to plate (262), by selectively adjusting the position of bolt (256) relative to bracket (258), and/or by removing/adding links from/to roller chain (244). Providing such adjustability of roller chain (244) at each end may eliminate the need for rotating winch (200) and/or drive shafts (230, 232, 234), etc. for positioning or tensioning of roller chain (244) in order to get sprockets (210, 212, 214, 216, 218, 220, 224, 226, 228), drive shafts (230, 232, 234), and roller chains (240, 242, 244) in proper synchronization. Bolt (256) and bracket (258) may be positioned at a depth within housing (20) such that they may be readily accessed by a person reaching in through the top of housing (20) (e.g., at less than a person's arm length). Of course, any other suitable features may be provided for adjustability as will be apparent to those of ordinary skill in the art in view of the teachings herein.

In use, winch (200) is activated to rotate sprocket (210) in one direction to raise barrier (10) to a deployed position; or in the other direction to lower barrier (10) to a retracted position. In particular, such activation of winch (200) ultimately rotates both end sprockets (224, 236), which causes end sprockets (224) to "climb" up or down their associated lifting roller chains (244). As described in greater detail below with reference to FIGS. 17-19, a counterweight system may be used to assist in the raising of barrier (10), thereby reducing the power that would otherwise be required of winch (200) to raise barrier (10). Of course, as with other features described herein, a counterweight system is merely optional. Furthermore, various other suitable types of systems may be used to selectively raise and lower barrier (10). Several exemplary alternative systems are described in greater detail below, while other exemplary alternative systems will be apparent to those of ordinary skill in the art in view of the teachings herein.

B. Exemplary Counterweight System

Figure 17:
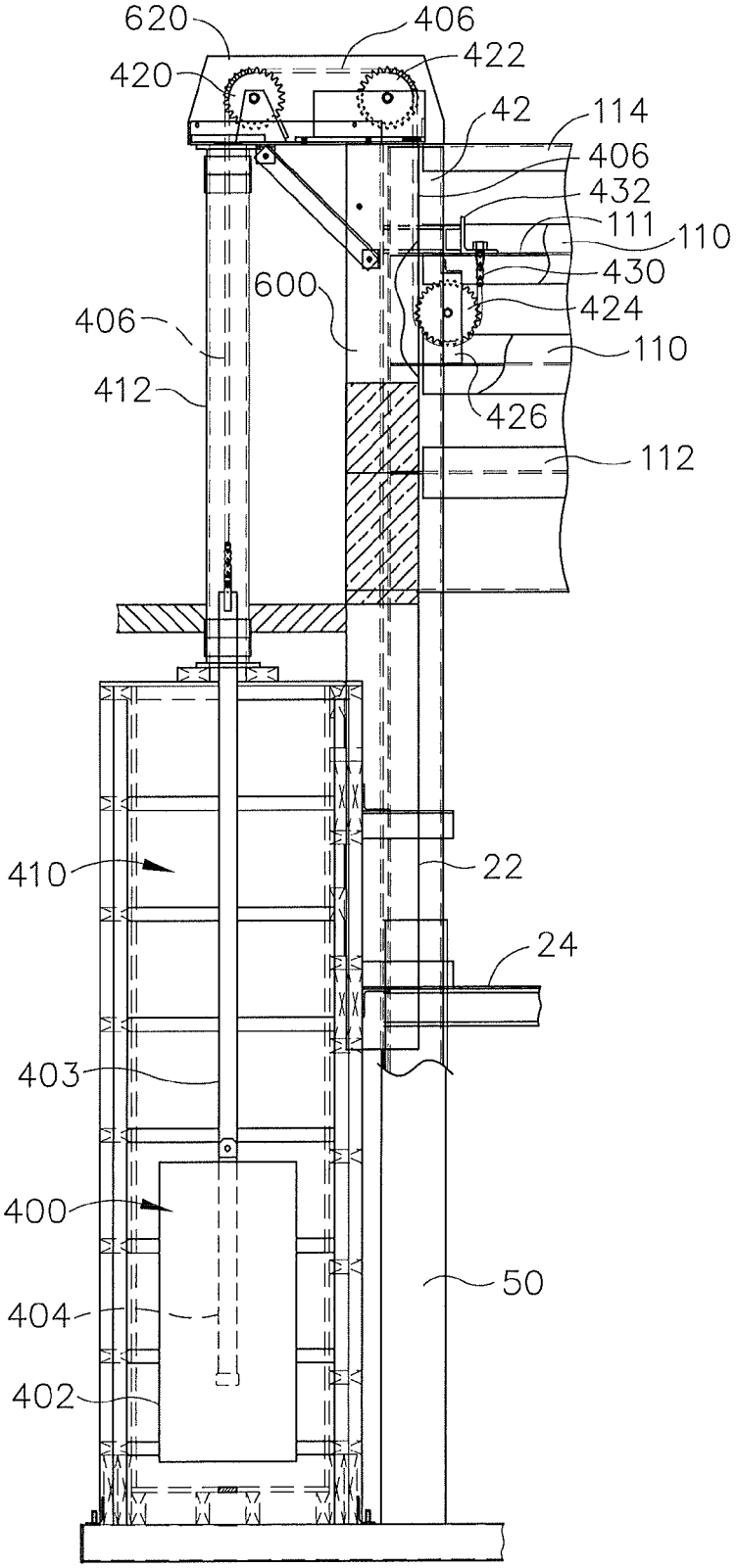
FIG. 17 depicts an elevational view of components of a counterweight assembly of the system of FIG. 1.
Figure 18:
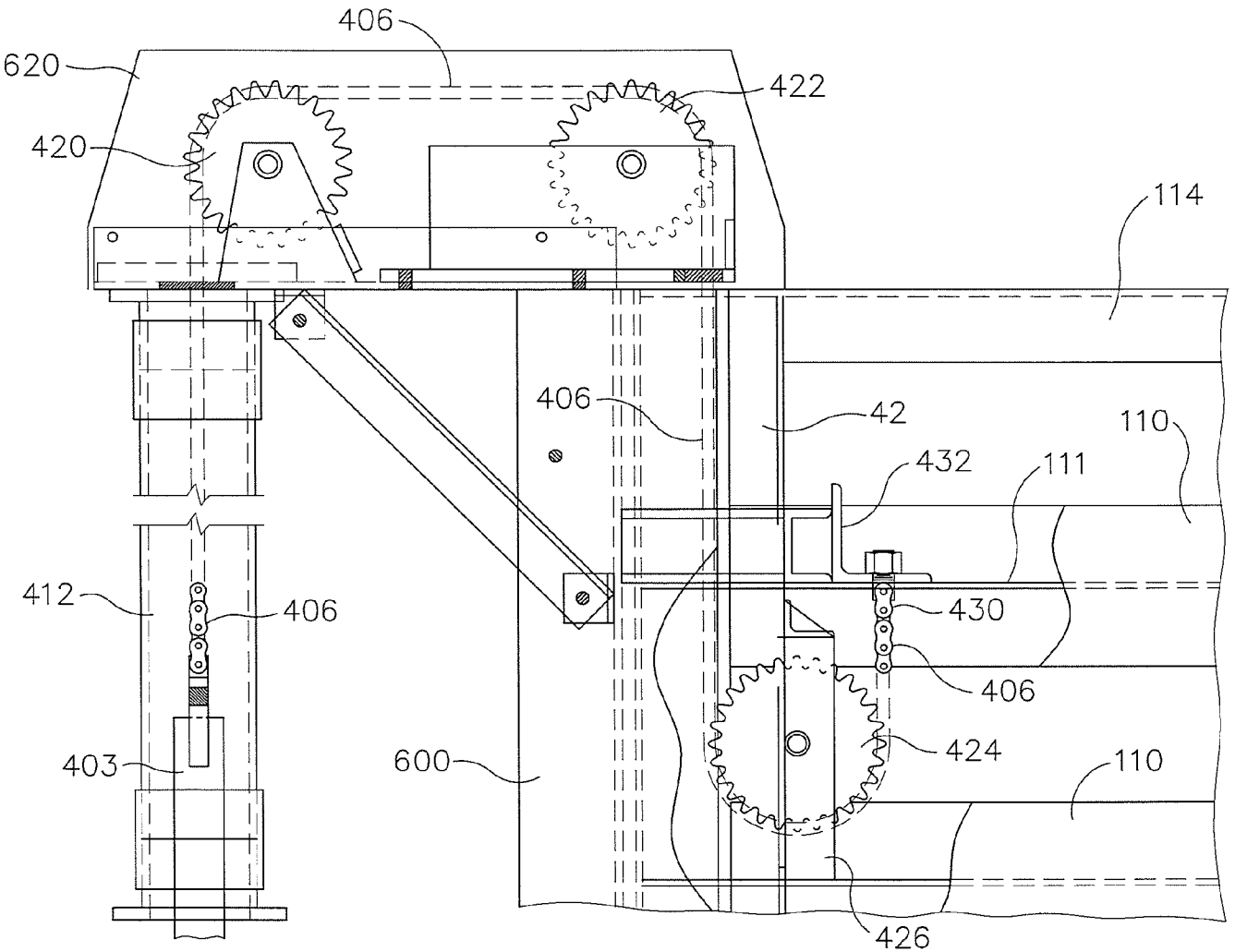
FIG. 18 depicts a partial elevational view of support features of the counterweight assembly of FIG. 17.
Figure 19:
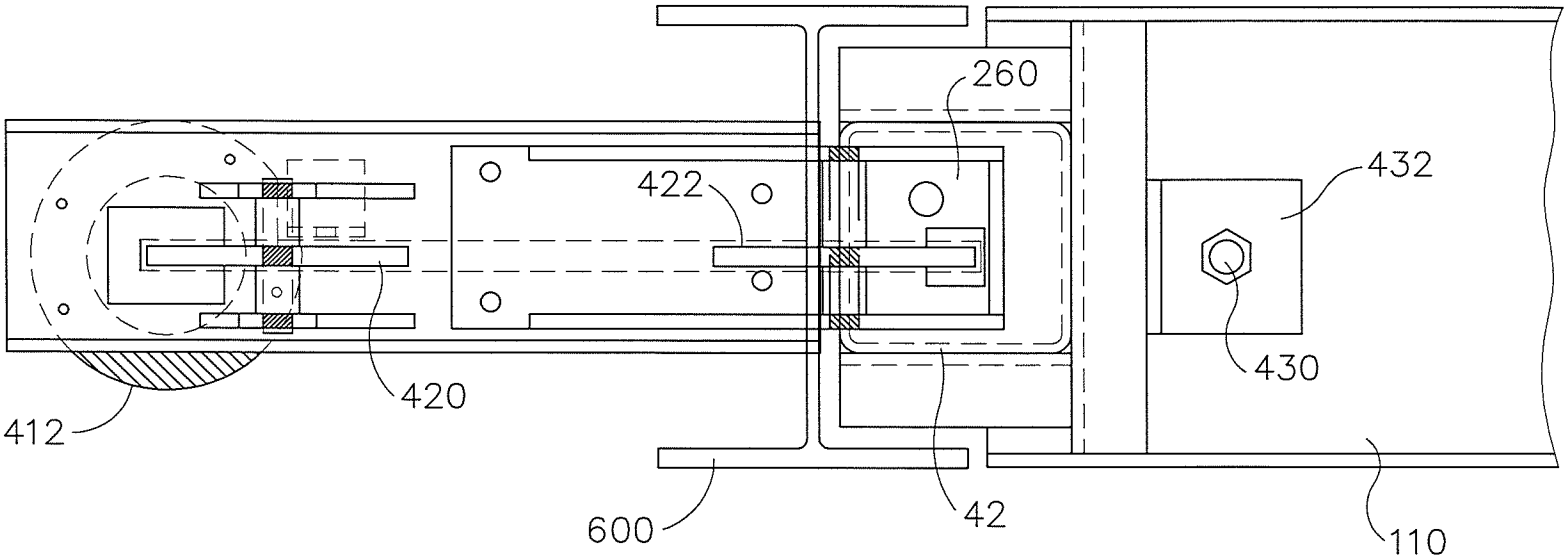
FIG. 19 depicts a top plan view of components of the counterweight assembly of FIG. 17.

In the present example, barrier system (10) includes a counterweight (400) that reduces the load on winch (200) as barrier (10) is raised to a deployed position. Counterweight (400) may thus reduce power consumption, reduce demand/wear on drive components, and provide for generally smoother operation of barrier (10) during raising and lowering. While FIGS. 17-19 illustrate counterweight (400) and associated components at just one end of barrier system (10), it should be understood that another counterweight (400) and associated components may be located at the other end of barrier system (10). It should also be understood that horizontal member (114) is omitted from FIG. 19 in order to improve the view of other components.

Counterweight (400) of the present example comprises a steel drum (402) filled with concrete, though counterweight (400) may of course take any other suitable form. An anchor (404) is embedded in the concrete and extends a substantial depth into steel drum (402). The combined weight of counterweight(s) (400) and anchor(s) (404) may be selected to approximate the weight of barrier (10), may be slightly greater than the weight of barrier (10), or may be slightly less than the weight of barrier (10). In the present example, the combined weight of counterweight(s) (400) and anchor(s) (404) is selected to permit barrier (10) to be raised manually (e.g., by one or two people) without any assistance from winch (200) (e.g., in the event of a power failure) and without the assistance of other mechanical means. Similarly, such a selection may permit barrier (10) to be lowered manually while reducing the risk of barrier (10) falling violently. By way of example only, an emergency rope, cable, lever, and/or other feature may be provided that is accessible from outside of barrier (10) and that selectively disengages a clutch in winch (200). With the clutch disengaged, winch (200) and other components of the drive system may rotate freely, allowing barrier (10) to be selectively raised or lowered manually. As noted above, counterweights (400) may greatly facilitate such manual raising or lowering.

A roller chain (406) is secured to anchor (404) via a linking bar (403). As will be described in greater detail below, roller chain (406) is also secured to gate beam (110). It should be understood that a cable or other structure may be used in addition to or in lieu of roller chain (406). Counterweight (400) is disposed in a chamber (410) that is adjacent to housing (20) underground (e.g., under barrier wall (650), etc.). Chamber (410) is sized to permit counterweight (400) to travel vertically during vertical travel of barrier (10). In particular, counterweight (400) is raised to an upper position in chamber (410) as barrier (10) is lowered to a retracted position. Conversely, counterweight (400) descends to a lower position in chamber (410) as barrier (10) is raised to a deployed position. A pipe (412) extends upwardly from chamber (410) and provides a path for roller chain (406) to reach a sprocket (420). Sprocket (420) is mounted at the top of barrier wall (650).

As best seen in FIG. 18, roller chain (406) further extends from sprocket (420) to another sprocket (422), which is mounted at the top of static guide (600). After passing over sprocket (422), roller chain (406) is directed downward to yet another sprocket (424). Sprocket (424) is mounted to post (42) by a bracket (426). Bracket (426) may be mounted to gate beam (110) in addition to or in lieu of being mounted to post (42), if desired. After passing over sprocket (424), roller chain (406) is secured to a bolt (430). Bolt (430) is adjustably secured to a bracket (432), which is fixedly secured to the central web member (111) of gate beam (110). Counterweight (400) is thus adjustably secured to gate beam (110) by roller chain (406). Bolt (430) may be adjusted relative to bracket (432) in order to adjust the effective length of roller chain (406).

It should be understood that slots or other openings may be provided in horizontal member (114) and/or in other components to accommodate the free passage of roller chain (406) therethrough. It should also be understood that sprocket caps (620), referred to above and shown in FIGS. 1-2, are configured to cover sprockets (420, 422) and the portion of roller chain (406) extending over sprockets (420, 422). As with other components described herein, sprocket caps (620) are merely optional. Still other suitable components, features, and configurations that may be used for a counterweight system for barrier (10) will be apparent to those of ordinary skill in the art in view of the teachings herein.

C. Exemplary Alternative Systems

While the above described examples include the use of counterweights, sprockets, roller chains, drive shafts, etc. to selectively raise and lower barrier (10). It should be understood that various other types of systems may be used to selectively raise and lower barrier (10). For instance, various combinations of folding arms, pulleys, and cables may be used as taught in U.S. Pat. No. 7,641,416, the disclosure of which is incorporated by reference herein. As another merely illustrative alternative, various combinations of arms, pulleys, and/or cables may be used as taught in U.S. Pub. No. 2010/0098486, the disclosure of which is incorporated by reference herein. It should therefore be understood that various teachings of U.S. Pat. No. 7,641,416 and U.S. Pub. No. 2010/0098486 may be combined together and with the teachings herein in numerous ways. As yet another merely illustrative example, barrier (10) may be selectively raised and/or lowered hydraulically, pneumatically, and/or in any other suitable fashion. Other suitable ways in which barrier (10) may be selectively raised and/or lowered will be apparent to those of ordinary skill in the art in view of the teachings herein.

III. Exemplary Cover Plates

Figure 20:
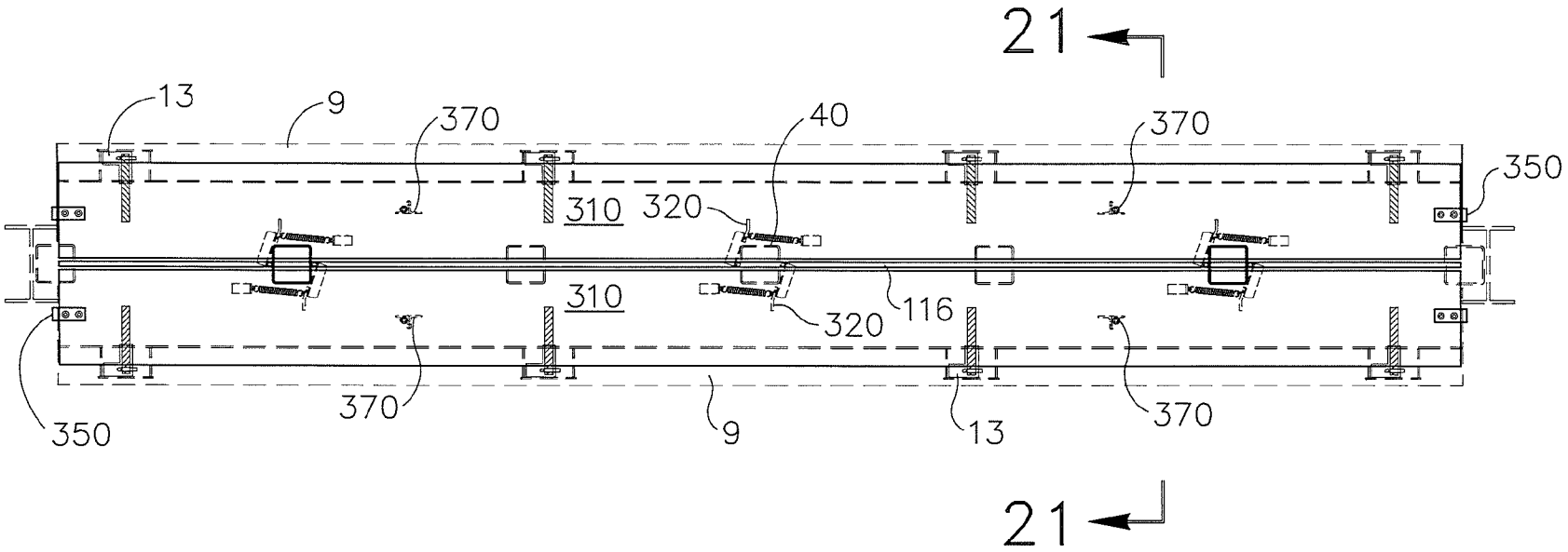
FIG. 20 depicts a top plan view of an exemplary cover plate assembly of the system of FIG. 1.
Figure 21:
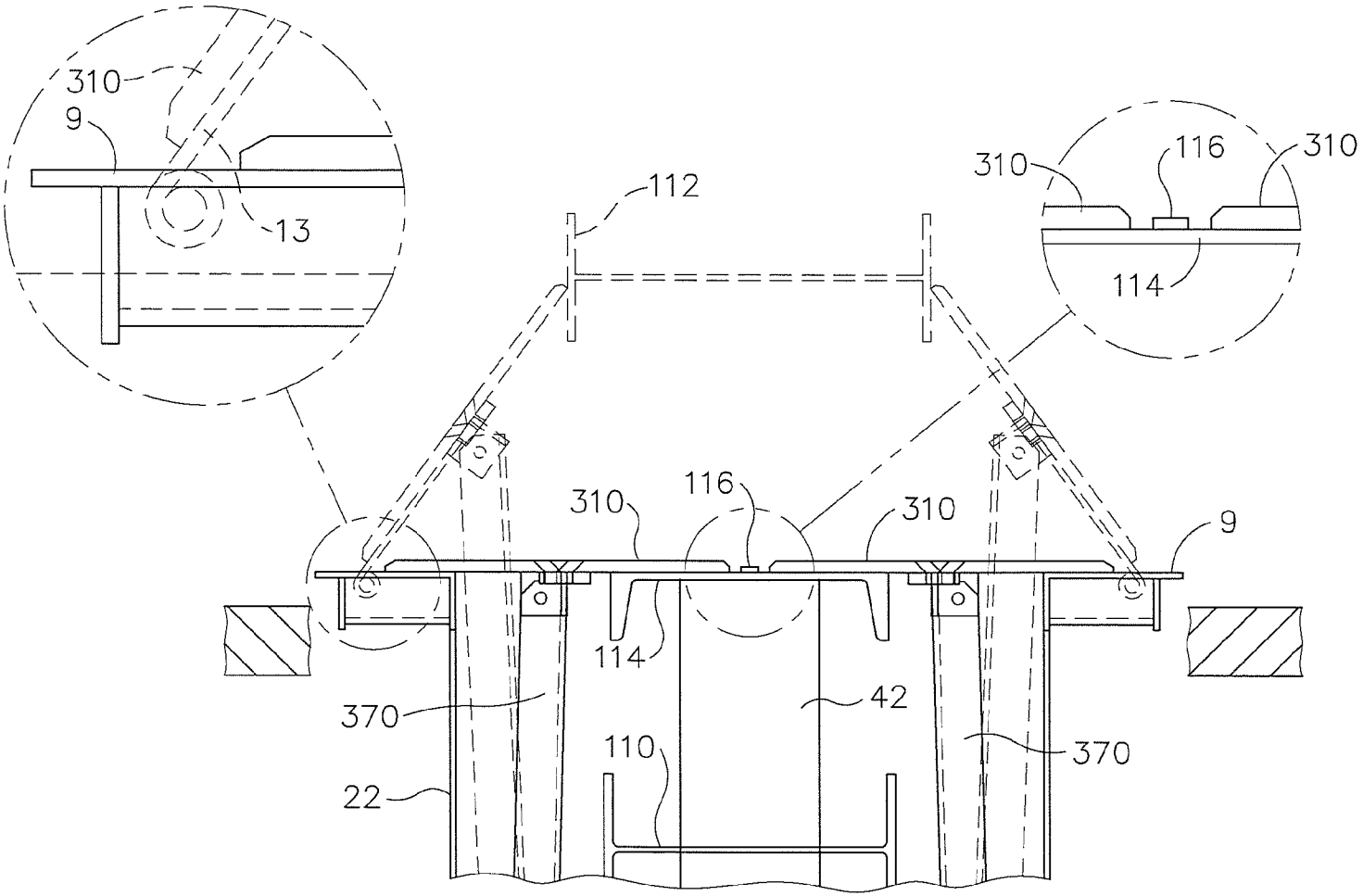
FIG. 21 depicts a partial cross-sectional view of the cover plate assembly of FIG. 20, taken along line 21-21 of FIG. 20.

Cover plates (310) are pivotally engaged relative to flanges (9) of housing (20), such that cover plates (310) may provide a selectively openable "lid" for barrier system (10). In particular, as best seen in FIGS. 20-21, cover plates (310) are each mounted to a respective set of hinges (13), each of which is mounted to a corresponding flange (9). While each cover plate (310) has a plurality of associated hinges (13) in the present example, some versions may provide just a single hinge (e.g., a continuous hinge or piano hinge) for each cover plate (310). As shown in FIG. 1, when cover plates (310) are down, cover plates (310) are configured to cover the opening defined by sidewalls (22) of housing (20). While a pair of pivoting cover plates (310) are shown, it will be appreciated that cover plate (310) may be varied or modified in a number of ways. For instance, a single hinged cover plate may be used. Furthermore, cover plates (310) may be modified to slide open, to swing downward into housing (20), or to open in any other suitable way. Other variations of cover plate (310) and methods of opening cover plate (310) will be apparent to those of ordinary skill in the art in view of the teachings herein.

Horizontal member (114) of the present example is configured to cooperate with cover plates (310) to cover the opening defined by sidewalls (22) of housing (20), when barrier system (10) is in the undeployed configuration shown in FIG. 1. For instance, horizontal member (114) may provide structural support underneath closed cover plates (310). In addition or in the alternative, horizontal member (114) may substantially fill a gap between closed cover plates (310). In the present example, cover plates (310) and horizontal member (114) (along with other load bearing components of barrier system (10)) may cooperate to fully bear the weight of numerous vehicles driving over cover plates (310) when cover plates (310) are in the retracted position as shown in FIG. 1, without causing any damage to cover plates (310) and horizontal member (114), etc. As shown in FIGS. 20-21, a metal strip (116) is secured to the top of horizontal member (114) to assist in partially filling the gap between closed cover plates (310), though metal strip (116) is of course merely optional. As another merely illustrative example, cover plates (310) may be omitted, such that horizontal member (114) itself substantially covers the opening defined by sidewalls (22) of housing (20), when barrier system (10) is in the undeployed configuration. Other suitable relationships between horizontal member (114) and cover plates (310) will be apparent to those of ordinary skill in the art in view of the teachings herein.

As yet another merely illustrative variation, barrier system (10) may include an integral cover plate (not shown) that is not hinged. For instance, an integral cover plate may span across the tops of posts (100, 101), and may have a width that is configured to overlay at least a portion of flanges (9) on both sides of housing (20). Thus, such an integral cover plate may fully cover or substantially cover the entire top opening defined by housing (20) when posts (100, 101) are in a retracted/undeployed position Like closed cover plates (310), such a "closed" integral cover plate may also be substantially flush with the ground when posts (40, 42) are in a retracted/undeployed position. Such an integral cover plate may also raise unitarily with posts (40, 42) as posts (40, 42) are raised to the deployed position. Still various other suitable ways in which the top opening defined by housing (20) may be fully covered or substantially covered will be apparent to those of ordinary skill in the art in view of the teachings herein.

Some versions may also include plates (not shown) on each side of hinges (13). Such plates may be configured to deflectingly force snow plow blades or the like to be raised above hinges (13), to avoid snow plow blades or the like getting snagged on hinges (13). For instance, such plates may wrap over at least part of the "knuckle" (e.g., the part that contains the hinge pin) of each hinge (12). As one merely illustrative alternative, each hinge (12) may be installed facing down such that the knuckles of hinges (13) are covered. To the extent that flanges (9) of housing (20) are exposed, such flanges (9) may include a beveled edge to also reduce the likelihood of snow plow blades or the like getting snagged on flanges (9). To the extent that tread plates or other components are positioned above flanges (9) and obscure flanges (9), such tread plates or other components may have such a beveled edge to also reduce the likelihood of snagging. In addition, cover plates (310) may each include a beveled edge to also reduce the likelihood of snow plow blades or the like getting snagged on cover plates (310). Of course, these features and configurations are merely optional, and may be varied, substituted, supplemented, or omitted as desired.

Figure 23:
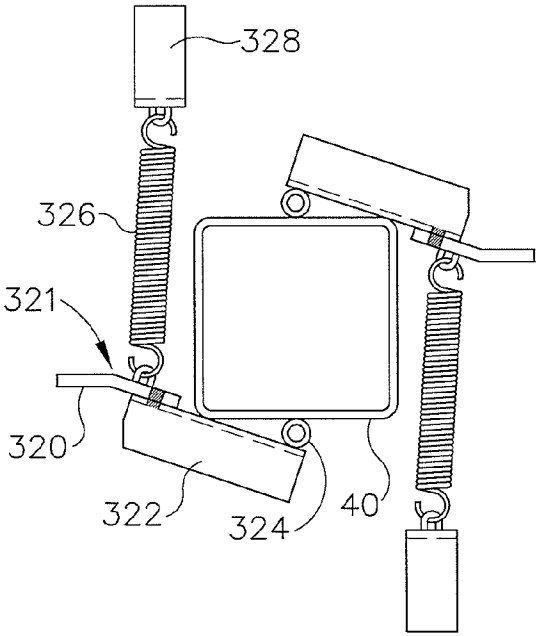
FIG. 23 depicts a cross-sectional view taken along line 23-23 of FIG. 22, showing a pair of the cover plate guide features of FIG. 22.
Figure 22:
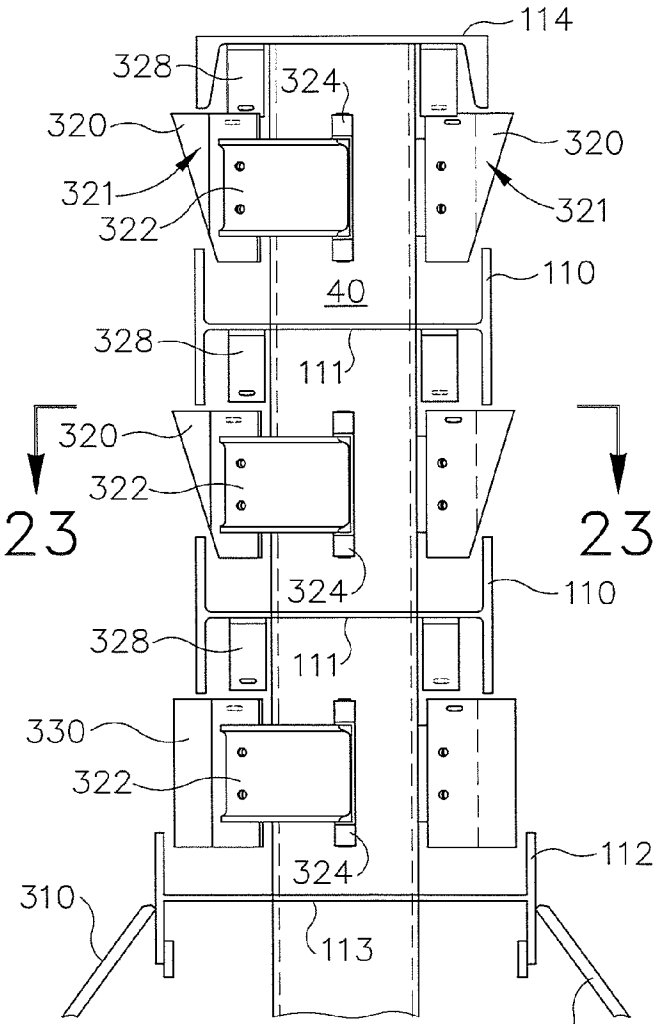
FIG. 22 depicts an elevation view of cover plate guide features for the cover plate assembly of FIG. 20.

FIGS. 9 and 22-23 show examples of features that may be used to assist with opening of cover plates (310) as barrier (10) is raised to the deployed position; and to prevent cover plates (310) from snagging on gate beams (110) and horizontal member (114) as barrier (10) is lowered to the retracted position. In particular, FIGS. 9 and 22-23 show a plurality of cover guide plates (320, 330) that are vertically positioned between gate beams (110, 112) and horizontal member (114). Each cover guide plate (320, 330) fixedly secured to a respective bracket (322), which is pivotally coupled to post (40) via a respective hinge (324). As best seen in FIG. 20, hinges (324) are positioned on opposing sides of each post (40) and are aligned along a longitudinally extending vertical plane defined by barrier system (10). In the present example, each post (40) has a set of six cover guide plates (320, 330), brackets (322), and hinges (324) mounted thereto. Posts (42) do not have any plates (320, 330), brackets (322), or hinges (324) mounted thereto in the present example.

Cover guide plates (320) have angled outer edges that deflect the free edges of cover plates (310) outwardly as barrier (10) is lowered to the retracted position, such that the outer edges of cover guide plates (320) prevent cover plates (310) from snagging on gate beams (110) and horizontal member (114) as barrier (10) is lowered to the retracted position. Cover guide plates (320) each thus define a non-rectangular trapezoidal shape in the present example. In the present example, cover guide plate (320) has a rectangular shape, though it should be understood that cover guide plate (320) may alternatively have a non-rectangular shape. It should also be understood that the configuration of gate beam (110) and cover guide plate (320) may still prevent cover plates (310) from snagging on the lowermost gate beam (110) as barrier (10) is lowered to the retracted position, even when cover guide plate (320) has a rectangular shape as shown in FIG. 22.

As best seen in FIG. 23, each cover guide plate (320, 330) also includes a bend (321), which is configured to orient the outermost portions of cover guide plates (320, 330) transversely relative to post (40) when cover guide plates (320, 330) are positioned as shown in FIGS. 9 and 22-23. As also best seen in FIG. 23, a spring (326) biases each cover guide plate (320, 330) to the position shown in FIGS. 9 and 22-23. One end of each spring (326) is secured to a respective cover guide plate (320, 330); while the other end of each spring (326) is secured to a respective block (328). Blocks (328) associated with the uppermost cover guide plates (320) are secured to the underside of horizontal member (114). Blocks (328) associated with the lower cover guide plates (320) are secured to the underside of central web member (111) of the upper gate beam (110). Blocks (328) associated with cover guide plates (330) are secured to the underside of central web member (111) of the lower upper gate beam (110).

Hinges (324) and springs (326) permit cover guide plates (320, 330) to pivot at hinges (324), such as when a vehicle strikes barrier (10) at an oblique angle. In settings where barrier system (10) is installed in the median of a highway (e.g., such that barrier system (10) runs parallel to the roadways), hinges (324) and cover guide plates (320, 330) are located on the sides of posts (40) that are downstream of the direction of traffic on the respective sides of barrier system (10). In other words, when cover guide plate (320, 330) is struck obliquely by a vehicle traveling along a first direction, hinge (324) permits cover guide plate (320, 330) to responsively pivot away from that vehicle and toward the opposite side of barrier system (10). In the event that cover guide plates (320, 330) are struck, springs (326) are biased to return cover guide plates (320, 330) to the position shown in FIGS. 9 and 22-23. Springs (326) and hinges (324) thus provide a degree of impact absorption, reducing the likelihood that cover guide plates (320, 330) and brackets (322) will be destroyed by vehicles striking barrier (10).

In addition to preventing cover plates (310) from snagging on gate beams (110, 112) and horizontal member (114) as barrier (10) is lowered to the retracted position. Cover plates (310) may also act as cams urging cover plates (310) outwardly as barrier (10) is raised to the deployed position. Once barrier (10) reaches the fully deployed position, gate beam (112) holds cover plates (310) in the substantially open position.

Figure 24:
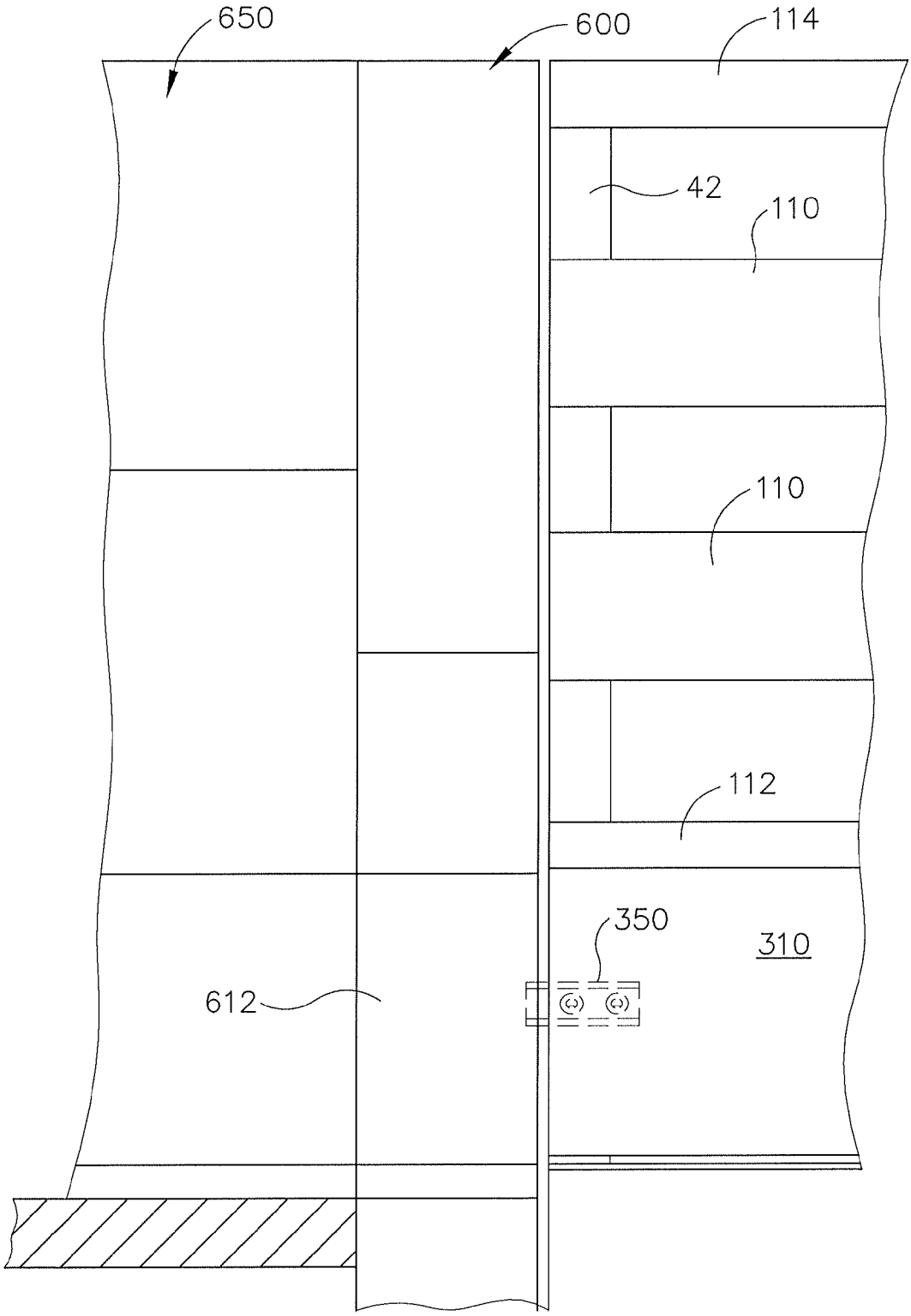
FIG. 24 depicts a front elevational view of a cover plate rotation restriction feature for the cover plate assembly of FIG. 20, viewed from the exterior of the system of FIG. 1.
Figure 25:
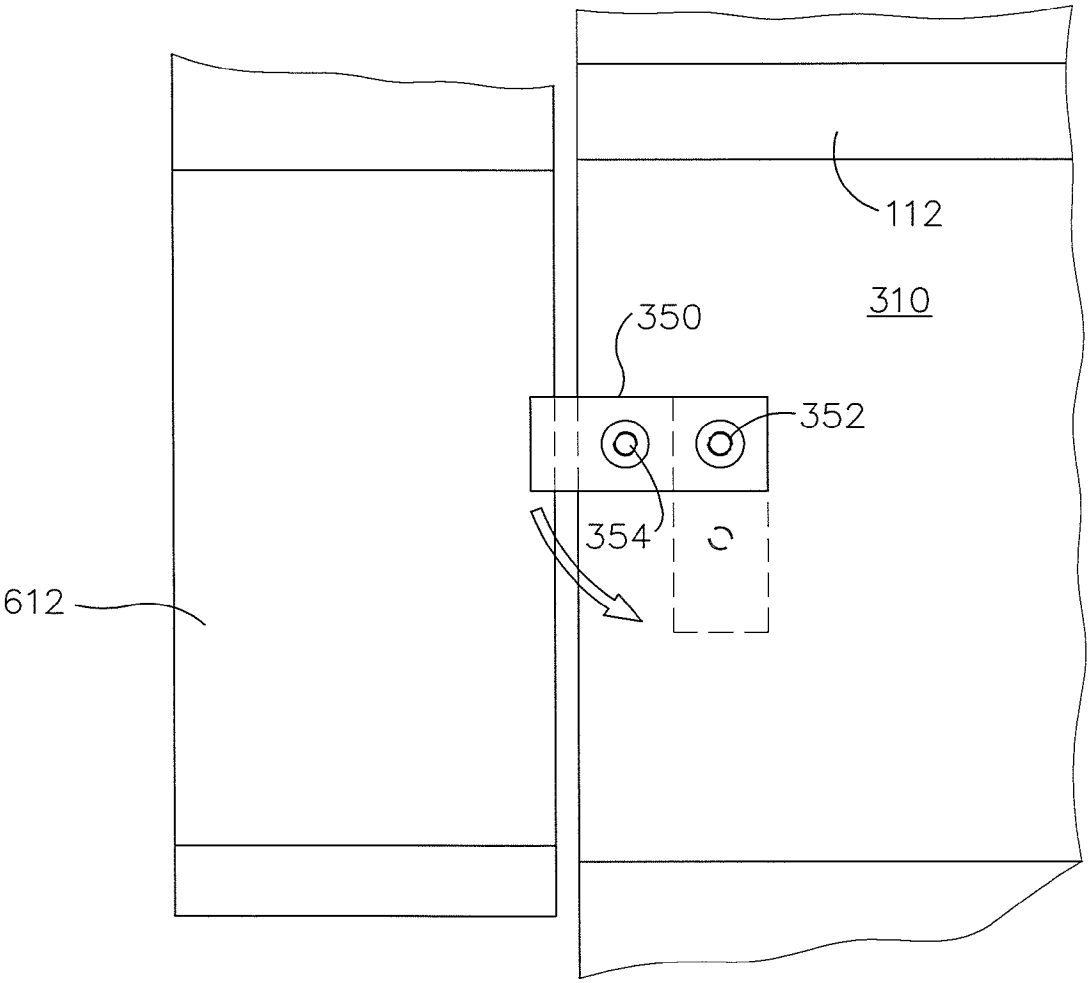
FIG. 25 depicts an enlarged rear elevational view of the cover plate rotation restriction feature of FIG. 24, viewed from the interior of the system of FIG. 1.
Figure 26:
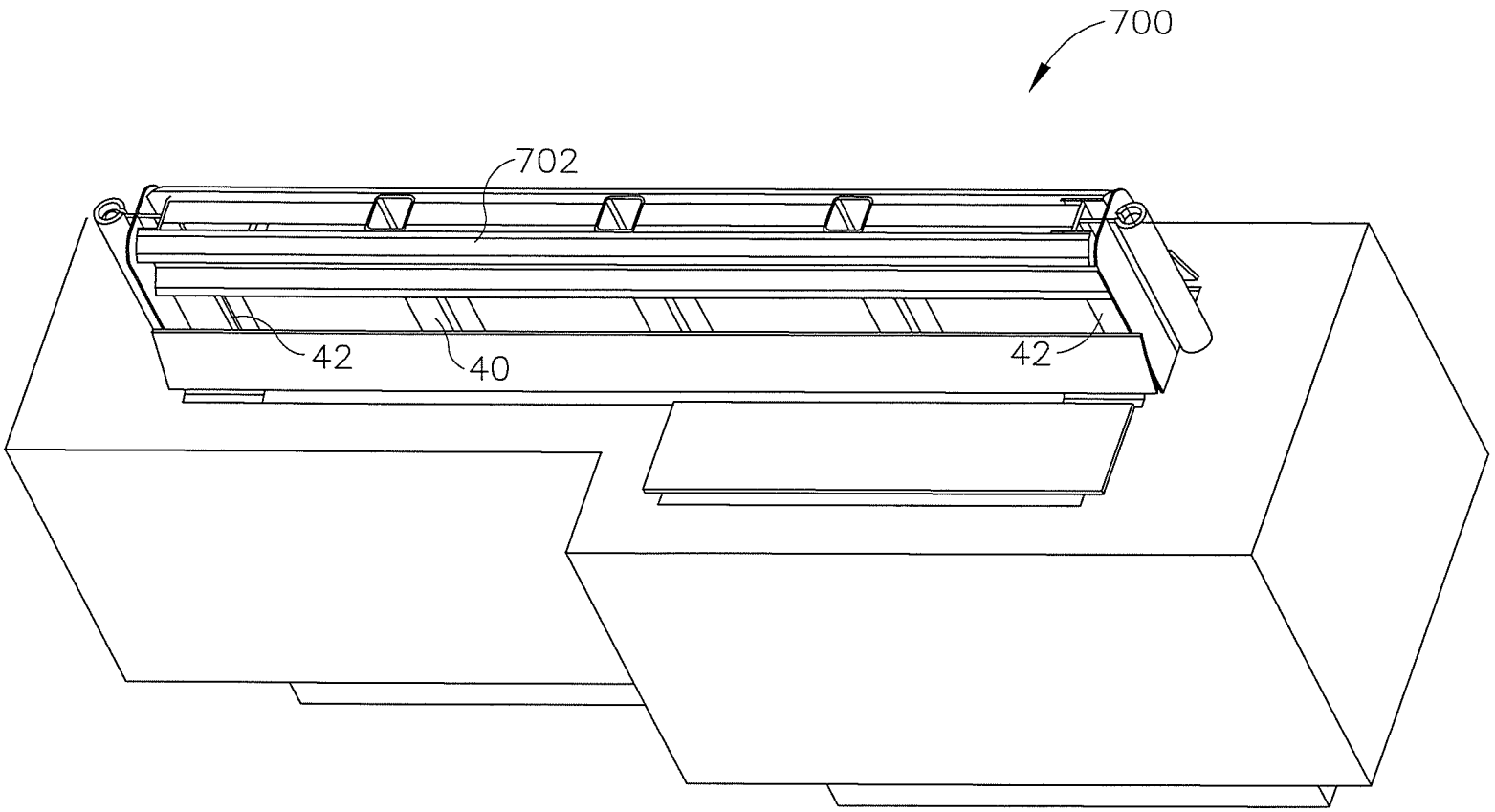
FIG. 26 depicts an exemplary alternative form that the exemplary vehicle barrier system of FIG. 1 may take.

FIGS. 24-25 show a merely illustrative example of a feature that may be used to restrict the degree to which cover plates (310) may be opened. In particular, FIGS. 24-26 show a locking member (350) that is secured to the underside of each cover plate (310) at each end of cover plate (310). Locking member (350) is a rectangular piece of metal in this example, though any other suitable configuration may be used. Locking member (350) is secured to cover plate (310) by a pair of bolts (352, 354). Bolts (352, 354) may be countersunk in cover plate (310) such that the flat heads of bolts (352, 354) do not protrude past the outer surface of cover plate (310). Bolt (352) is configured to pivotally secure locking member (350), such that locking member (350) may pivot about bolt (352) and relative to cover plate (310) when bolt (354) is removed. For instance, bolt (352) may include a nylon nut (not shown). Bolt (354) is configured to lock the rotational position of locking member (350) about bolt (352) and relative to cover plate (310). When bolt (354) is secured to locking member (350) (e.g., in complementary threading formed in locking member (350), etc.), locking member (350) extends in a direction that is substantially parallel to the direction along which cover plate (310) extends, such that locking member (350) and cover plate (310) are substantially parallel. In this position, locking member (350) extends past the end of cover plate (310) and under foot portion (612) of static guide (600) (e.g., by approximately one inch). Thus, engagement between locking member (350) and foot portion (612) of static guide (600) restricts the degree to which cover plate (310) may be opened. In particular, locking member (350) ensures that cover plates (310) do not open past planes defined by foot portions (612) of static guides (600), such that locking members (350) assist in keeping a substantially smooth transition from foot portions (612) to cover plates (310) when cover plates (310) are opened.

In the event that cover plates (310) need to be opened further (e.g., to perform maintenance or inspections in housing (20), etc.), bolt (354) may be removed, allowing locking member (350) to pivot as shown in FIG. 25 to a position where it will not engage foot portion (612) of static guide (600) as cover plate (310) is opened. In particular, the absence of bolt (354) and the pivotal relationship provided by bolt (352) and the nylon nut (not shown) allows locking member (350) to rotate to a position where it is oriented transversely relative to cover plate (310). After the maintenance/inspection/etc. is complete, cover plate (310) may be rotated back toward a position where it is no longer "hyperextended" relative to foot portion (612) of static guide (600), then locking member (350) may be rotated back to a position where it is substantially parallel to cover plate. Bolt (354) may then be secured to cover plate (354) and locking member (350) to hold locking member (350) in this position. It should be understood that locking member (350) may be modified, substituted, or supplemented in numerous ways. It should also be understood that locking member (350) may be readily incorporated into virtually any form of barrier described herein. Of course, as with other components described herein, locking member (350) may simply be omitted if desired.

FIGS. 9 and 21 show additional features that assist with closure of cover plates (310) as barrier (10) is lowered to the retracted position. In particular, the upper end of a closure beam (370) is pivotally secured to the underside of each cover plate (310). The lower ends of closure beams (370) are pivotally coupled to a shared cross-beam (372). By way of example only, beams (370, 372) may comprise angle irons or any other suitable structures. When cover plates (310) are opened during deployment of barrier (10), closure beams (370, 372) are raised to and held in the position shown in FIG. 9. As barrier (10) is subsequently being lowered to the retracted position, gate beam (112) eventually engages cross-beam (372). As barrier (10) continues to be lowered, gate beam (112) pushes downwardly on cross-beam (372), which pulls cover plates (310) closed via closure beams (370). While barrier (10) remains in the retracted position, gate beam (112) and beams (370, 372) cooperate to hold cover plates (310) in the closed position. While just one set of beams (370, 372) are shown in the present example, it should be understood that any suitable number of sets of beams (370, 372) may be incorporated into barrier system (10). By way of example only, one end of barrier system (10) may have one set of beams (370, 372) while the other end of barrier system (10) may have another set of beams (370, 372).

Of course, there are a variety of other structures, components, and techniques that may be employed to provide opening, holding open, closing, and/or closing of cover plates (310), in addition to or in lieu of those described above. By way of example only, lift assist springs (not shown) may be provided to assist in opening of cover plates (310). Similarly, a spring or other resilient member may bias cover plates (310) to a closed position. It should also be understood that, in versions where at least one limiting chain, cable rod, and/or linkage is used to restrict the degree to which cover plates (310) may be opened, completely separate chain(s), cable(s), rod(s), and/or linkage(s) may be used to assist in closing cover plates (310). Numerous examples of alternative features that may be used to assist with opening and/or closing of cover plates (310) are disclosed in U.S. Provisional Patent Application No. 61/510,194, the disclosure of which is incorporated by reference herein; U.S. Pub. No. 2010/0098486, the disclosure of which is incorporated by reference herein; and U.S. Pat. No. 7,641,416, the disclosure of which is incorporated by reference herein. Still other suitable structures, components, and techniques for opening, holding open, and/or closing cover plates (310) will be apparent to those of ordinary skill in the art in view of the teachings herein.

IV. Exemplary Alternative Barrier Configurations

Figure 27:
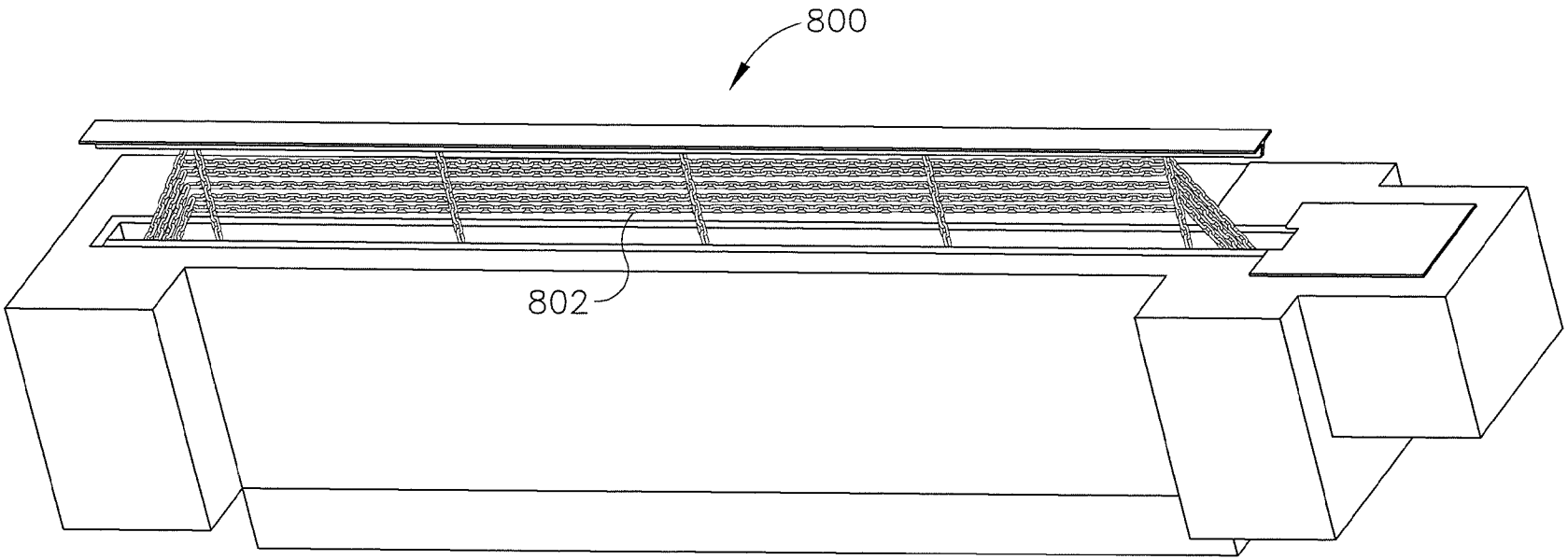
FIG. 27 depicts another exemplary alternative form that the exemplary vehicle barrier system of FIG. 1 may take.
Figure 28:
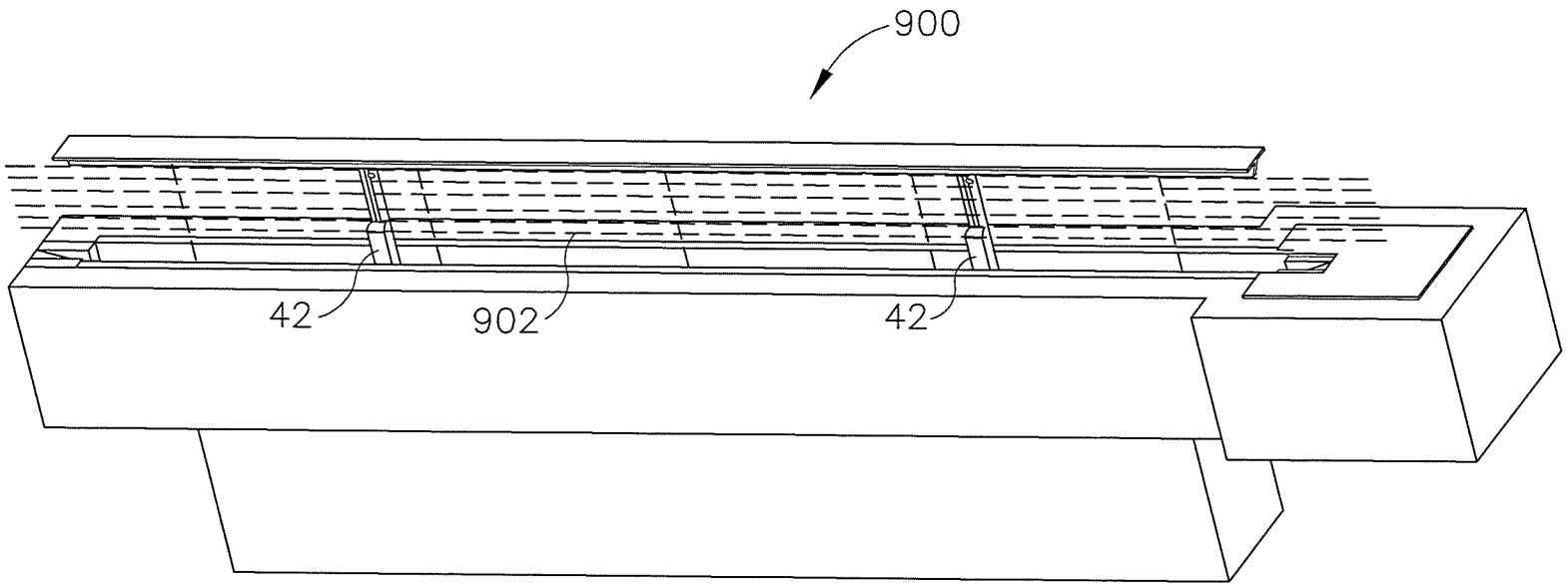
FIG. 28 depicts yet another exemplary alternative form that the exemplary vehicle barrier system of FIG. 1 may take.

In the examples shown in FIGS. 1-25, a barrier is provided by gate beams (110, 112) and horizontal member (114). However, it should be understood that a barrier system may include various other kinds of barrier features. By way of example only, FIG. 26 shows a barrier system (700) that includes conventional guardrails (702) to provide a barrier. FIG. 27 shows a barrier system (800) that includes a plurality of chains (802) to provide a barrier. FIG. 28 shows a barrier system (900) that includes a plurality of steel cables (902) to provide a barrier. It should be understood that various teachings provided herein with respect to barrier system (10) may be readily incorporated into any of these types of alternative barrier systems (700, 800, 900), among others. Other suitable types of barrier systems into which at least some of the teachings herein may be incorporated will be apparent to those of ordinary skill in the art.

It should also be understood that numerous versions of the barrier systems (10, 700, 800, 900) described herein may be readily integrated into pre-existing conventional fixed barrier systems, such as pre-existing conventional jersey barriers, pre-existing conventional guardrail barriers, pre-existing conventional chain barriers, and pre-existing conventional cable barriers. For instance, one or more of the barrier systems (10, 700, 800, 900) described herein may provide a selective pass-through in such conventional barrier systems, enabling people and/or vehicles to retract the barrier system (10, 700, 800, 900) to pass through a gap in the conventional barrier then subsequently redeploy the barrier system (10, 700, 800, 900) to close the gap after passing through. Several examples of how barrier systems such as those taught herein may be incorporated into a pre-existing conventional fixed barrier systems are described in U.S. Pub. No. 2010/0098486, the disclosure of which is incorporated by reference herein, and U.S. Pat. No. 7,641,416, the disclosure of which is incorporated by reference herein, while still other suitable examples will be apparent to those of ordinary skill in the art in view of the teachings herein.

V. Exemplary Control

Control of barrier system (10) may be provided in a variety of ways, and may include one or more microprocessors and/or various other types of control module components that will be apparent to those of ordinary skill in the art in view of the teachings herein. In some versions, control is provided locally. For instance, a switchbox or other device may be located proximate to barrier system (10) to permit selective activation of winch (200). Such a switchbox may include any of a variety of security features, including but not limited to keyed control, a card reader (e.g., using a magnetic strip, RFID technology, EAS technology, etc.), a keypad for entry of a code, a biometrics reader, or any other suitable security feature. Barrier system (10) may also be triggered by an in-road sensor or other device. Furthermore, barrier system (10) may be capable of manual operation, such as in the case of a power loss or under other circumstances.

In some versions, control is provided remotely. For instance, in some versions, winch (200) is in communication with a small portable remote control device, similar to a conventional garage door opener controller. In particular, a receiver (not shown) may be coupled with winch (200), and may be configured to receive commands from a remote control device, and translate such commands into corresponding operation of winch (200) to deploy or retract posts (40, 42) and gate beams (110, 112). Such communication may be encrypted using a rolling code or any other suitable techniques, such that the receiver only responds to a particular remote control device or particular group of remote control devices. By way of example only, suitable personnel such as firefighters, ambulance drivers, highway patrol, etc., may be provided with such remote control devices. Alternatively, to the extent that a building is wholly or partially surrounded by a barrier system (10), a building manager, building security, or other personnel may be provided with such a remote control device. Still other suitable personnel and other ways in which a portable remote control device may be used with barrier system (10) will be apparent to those of ordinary skill in the art in view of the teachings herein.

As another merely illustrative example of remote control, winch (200) may be in communication with a network, such that a user may selectively activate winch (200) from a remote location, via wire or wirelessly. Such a network may be a dedicated closed network, the Internet, or any other communication structure. It will be appreciated that any of the security features noted above with respect to local control of barrier system (10) may also be implemented for remote control of barrier system (10). It will also be appreciated that one barrier system (10) may be in communication with one or more other barrier systems (10). For instance, one barrier system (10) may act as a "master" system, such that other barrier systems (10) will automatically deploy or retract in response to deployment or retraction of the "master" system. Alternatively, one barrier system (10) may act as a relay for data or commands to and/or from other barrier systems (10). To the extent that a barrier system (10) is in communication with some type of network, operational data may be communicated to a remote location via the network. For instance, the charge left in the battery, the operability of winch (200), the presence of water or debris in the vault or housing (20), the striking of posts (40, 42) and/or gate beams (110, 112) by a vehicle, or any other type of data may be communicated via a network.

Barrier system (10) may also include safety or warning features such as lights or horns when barrier system (10) is activated. For instance, one or more limit switches or proximity sensors, etc. may be used to stop winch (200) when posts (40, 42) have reached a fully raised/deployed and/or a fully lowered/retracted position. By way of example only, limit switches may comprise at least one metal tab or other structure mounted to at least one of the posts (40, 42) that provides contact with another switch position when posts (40, 42) have reached a fully raised/deployed and/or a fully lowered/retracted position. Alternatively, limit switches may take any other suitable form, to the extent that limit switches are even used. In addition, barrier system (10) may include a kill switch to prevent deployment of barrier system (10) when a person or obstacle is detected in the path of barrier system (10); and/or when there is a limit switch failure. Suitable components and arrangements for providing such sensor and kill switch systems will be apparent to those of ordinary skill in the art in view of the teachings herein.

As yet another merely illustrative variation, barrier system (10) may include a control module and/or other component that monitors the amount of electrical current drawn by winch (200). Such a control module and/or other component may be configured to shut down winch (200) in response to detecting the drawn electrical current exceeding a threshold value (e.g., a value that would indicate an overload on winch (200), etc.). This may prevent components of barrier system (10) from being damaged when winch (200) is overloaded. Still other ways in which barrier system (10) may be controlled or monitored will be apparent to those of ordinary skill in the art in view of the teachings herein. Similarly, various other suitable components, features, configurations, operabilities, and uses of barrier system (10) will be apparent to those of ordinary skill in the art in view of the teachings herein. By way of example only, a substitute or supplement for gate beams (110, 112) may include guardrails, chains, cables, rods, bars, rails, ropes, netting, plates, or any other suitable structures, including combinations of such structures, and including any suitable material or combination of materials.

VI. Exemplary Uses

It will be appreciated by those of ordinary skill in the art that each barrier system described herein may be used in a variety of ways. In one merely exemplary use, a barrier system is positioned in a median of a multi-lane highway or interstate, between a pair of preexisting median barriers such as preexisting guardrails, cables, Jersey barriers, or concrete walls, etc. For instance, a barrier system may be constructed into a new concrete barrier wall, positioned in a preexisting gap between preexisting barrier walls, or "cut into" a preexisting barrier wall, etc. Guide plates or other features may be mounted to the preexisting median barriers in order to guide or reinforce one or more portions of barrier system (e.g., guardrails, etc.). Concrete of the barrier system or any other component of the barrier system may also be anchored with a preexisting concrete median wall. In this example, the barrier system is oriented substantially parallel to the flow of traffic on a roadway, and is configured to restrict passage across a highway median rather than restricting passage across a lane of a roadway. It will be appreciated that having a barrier system in such a location may be useful for emergency vehicles that need to cross the median of a highway or interstate, etc., who may otherwise need to travel substantial distances out of the way just to get to the other side of the highway. Furthermore, a barrier system may be installed where gaps already exist between median barriers (e.g., where such gaps were created for use by patrol cruisers or emergency vehicles), and may be set in a deployed configuration by default to prevent unauthorized use of such gaps by non-state and non-emergency vehicles, such that obstructive portions of the barrier system may be lowered when authorized vehicles need to cross the median.

Similar to the example above, a barrier system may be positioned in the median of a highway that does not have guardrails or walls in the median. In particular, a barrier system may be positioned in the median of a highway that uses cables and posts to prevent vehicles from crossing the median. For instance, some such medians may currently have openings in the cable and post lines to permit emergency vehicles to cross the median. A barrier system may be positioned in such paths to prevent non-emergency vehicles from crossing such paths while permitting emergency vehicles to lower the barrier to permit passage through the paths. In versions that use horizontally oriented cables to present a barrier to vehicles, the cables of the retractable barrier system may tie into the preexisting system of cables and posts in the median. For instance, the cables of the barrier system may be coupled with whichever posts or cables are immediately adjacent to each end of barrier system. As yet another alternative, a barrier system may be retrofitted to a preexisting cable median barrier system such that the posts are coupled directly with a span of the preexisting cables, and such that the posts and the horizontal member may be used to selectively raise and lower the preexisting cables. It should also be understood that a barrier system as described herein may be overlapped with a preexisting barrier system, such that neither system is struck by a vehicle at its upstream termination point. For instance, such overlap may result in a vehicle first striking a barrier as described herein and then sliding into the preexisting barrier. Still other ways in which a barrier system may be used in conjunction with a preexisting system of posts and cables in a highway median will be apparent to those of ordinary skill in the art in view of the teachings herein.

In another merely exemplary use, a barrier system is provided in a roadway (not shown). The barrier system may have a length such that it extends across the width of the roadway to any suitable length (e.g., across one or more traffic lanes in the roadway, across the entire width of the roadway, etc.). To permit normal passage of traffic across the roadway, the barrier system may be kept in a retracted configuration. When the provision of a barrier is desired, winch (200) (or some other type of component) may be activated to transition the barrier system to a deployed configuration. Such a deployed barrier system may provide a barrier substantially preventing passage of vehicles approaching the barrier system from either direction. If a vehicle strikes one or more obstructive portions of the barrier system, the barrier system may quickly bring such a vehicle to a stop. Alternatively, if a vehicle does not strike the barrier system, and if a barrier is no longer desired, winch (200) (or some other type of component) may be activated again to transition the barrier system back to the retracted configuration to once again permit passage of vehicular traffic.

While barrier systems have been described as being capable of spanning across an entire width of a roadway, it will be appreciated that a barrier system may span across any other suitable length. For instance, a barrier system may span across only one lane of traffic. Alternatively, a barrier system may be configured to span across distances that far exceed the width of a roadway. For instance, a barrier system may be constructed to span across the entire width of the face of a building, park, or other location, or may be constructed to span around the entire perimeter of such a location.

In another exemplary use, a barrier system is installed behind a pre-existing gate (not shown) that it is used to selectively restrict access to a road, driveway, or the like. The barrier system may therefore provide reinforcement or a "back up" for existing barriers (e.g., where existing barriers are less able to prevent passage of a moving vehicle intent on passing through the barrier). The barrier system may thus be used to provide security for non-authorized vehicle entry. As another merely exemplary use, a barrier system may be used by the military to provide checkpoints, by police to provide blockades, or by other persons or entities for a variety of purposes.

It should also be understood that a barrier system may be constructed such that it spans around corners, such as at right angles, along a curve, or otherwise (e.g., to conform to property lines or desired security perimeter, etc.). For instance, one or more cables or chains could easily be extended around a corner using a pulley or other component. Similarly, any suitable number of cables may be coupled with a deployment cable or a retraction cable via a clevis or other component, and such additional cables may be extended around a corner using a pulley or other component. Thus, even if several deployment posts are used at different positions about one or more corners, such deployment posts may all be simultaneously deployed using a single winch in some implementations. For instance, a single barrier system may be arranged in a rectangle or square surrounding the perimeter of an entire building, and a single winch may be used to simultaneously raise and/or simultaneously lower posts on all four sides of the building perimeter. Such posts could be positioned at each side of each corner and/or elsewhere.

It will also be appreciated that, in many situations, length may be added to a barrier system simply by lengthening guardrails, chains, cables, gate beams, etc., and possibly adding additional vertical posts. For instance, a barrier system with chains and/or a barrier system with cables may be used to protect areas that span 200 feet or more (e.g., as opposed to just one traffic lane spanning 12 feet). Furthermore, in many situations, all posts may still be deployed by a single drive mechanism (e.g., winch). To the extent that increasing the length of barrier system requires the addition of more posts additional cables may be easily coupled with cables described herein, and additional pulleys may be provided, as desired.

It should be understood that any barrier system described herein may include an audio and/or visual warning system that may be activated when the barrier system is transitioning from an extended position to a retracted position; and or when barrier system is transitioning from a retracted position to an extended position. For instance, such a warning system may include a horn/klaxon, bell, or other type of alarm and/or a flashing light, etc. Such a warning system may thus provide a warning to traffic that the barrier system is changing its position.

Of course, a barrier system may be used in a variety of other contexts and for a variety of other purposes. Various other contexts and purposes in which a barrier system may be used, as well as various other techniques for using a barrier system, will be apparent to those of ordinary skill in the art in view of the teachings herein.

It will be understood in view of the above that a deployed barrier system may provide a bi-directional barrier. Furthermore, barrier system is operable to provide such a barrier with a single drive mechanism (e.g., winch). In some versions as described above, the drive mechanism that is used to deploy a barrier is mechanical or electromechanical, such as a winch or some other mechanical/electromechanical device. It will be appreciated that, where a mechanical or electromechanical drive mechanism is used, the barrier system may be substantially free of any hydraulic or pneumatic devices. In other words, a drive mechanism need not rely on hydraulics or pneumatics to operate, which may be preferable in certain situations. In other situations, hydraulics or pneumatics may be preferred, and a hydraulic or pneumatic device may be incorporated into a barrier system, either for a drive mechanism or otherwise.

Barrier systems have been described herein as deploying obstructive components in a manner that does not require a sweeping motion that is transverse to a longitudinal plane defined by the barrier system. Instead, obstructive components of the barrier system (e.g., guardrail, chains, cables, gate beams, etc.) simply move up and down along the longitudinally extending vertical plane defined by the barrier system during deployment and retraction. It will be appreciated that the absence of transverse sweeping by such components for deployment of such components may permit the barrier system to occupy a relatively short portion of a lane of a roadway. Those of ordinary skill in the art will recognize that the narrow profile achieved by relying on deployment motion that is along a longitudinally extending vertical plane of the barrier system (and therefore transverse to roadway—vertically transverse and/or horizontally transverse as opposed to parallel) may ease installation of the barrier system or provide other benefits. Alternatively, a barrier system may be modified to have a deployment motion that spans across any other suitable plane, including those transverse to a longitudinal plane defined by the barrier system or those that are parallel with the roadway.

Any version of a barrier system may include a heavy canvas, rubber sheeting or strips, sheet metal, and/or any other suitable structures or material(s) to substantially cover and protect the interior of the vault or housing from debris and/or snow, etc. when the barrier system is in the fully deployed position. Such a protective covering may even be provided in versions where cover plates already provide some degree of protection to the interior of the vault or housing. Such a protective covering may be secured to one or more portions of the vault or housing and/or to any other suitable components of the barrier system.

It should also be understood that a barrier system may be configured to substantially prevent or at least reduce the likelihood of a vehicle's wheel getting snagged on the barrier system when a vehicle strikes the barrier system. For instance, components of barrier system may be sized, spaced, and otherwise arranged (relative to each other and relative to surrounding structures such as the ground) to substantially prevent or at least reduce the likelihood of wheel snagging. Various ways in which a barrier system may be configured to substantially prevent or at least reduce the likelihood of wheel snagging will be apparent to those of ordinary skill in the art in view of the teachings herein. It should also be understood that posts (or portions thereof) may be configured to break away from other components of the barrier system upon sufficient impact by a vehicle, such as to prevent or reduce snagging.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims, and is understood not to be limited to the details of structure and operation shown and described in the specification and drawings.

I claim:

1. A vehicle barrier system, comprising:

(a) a housing;

(b) a vertical guide fixedly secured relative to the housing;

(c) a plurality of substantially vertical members;

(d) at least one barrier member coupled with the substantially vertical members, wherein the at least one barrier member is configured to stop a moving vehicle when the substantially vertical members are in a raised position relative to the housing; and (e) an actuation assembly operable to selectively raise and lower the substantially vertical members relative to the housing to selectively deploy and retract the at least one barrier member relative to the housing, wherein the vertical guide is configured to guide at least one of the substantially vertical members during deployment and retraction of the at least one barrier member, wherein the actuation assembly comprises:

(i) a powered rotary actuator mounted to the at least one barrier member, (ii) a roller chain, wherein the roller chain has a first end and a second end, wherein the roller chain defines a vertical length between the first end and the second end, wherein the first end is fixedly secured to the vertical guide, wherein the second end is fixedly secured to the vertical guide, wherein the at least one barrier member is configured to carry the powered rotary actuator up and down as the at least one barrier member travels up and down between a raised position and a lowered position, wherein the actuation assembly is operable to convert rotary motion from the rotary actuator into linear movement of the at least one barrier member to thereby drive the at least one barrier member between the raised position and the lowered position, wherein the at least one barrier member is configured to travel vertically along a portion of the length of the roller chain between the first end and the second end as the at least one barrier member is driven between the raised position and the lowered position.

2. The vehicle barrier system of claim 1, wherein the rotary actuator comprises a winch.

3. The vehicle barrier system of claim 1, wherein the at least one barrier member is configured to travel along a vertical plane, wherein the rotary actuator is configured to travel along the vertical plane with the at least one barrier member.

4. The vehicle barrier system of claim 1, wherein the at least one barrier member defines a longitudinal axis, wherein the actuation assembly further comprises a drive shaft in communication with the rotary actuator, wherein the drive shaft is rotatable about an axis that is parallel to the longitudinal axis of the at least one barrier member.

5. The vehicle barrier system of claim 4, wherein the drive shaft is mounted to the at least one barrier member.

6. The vehicle barrier system of claim 1, wherein the actuation assembly further comprises:

a driven sprocket, wherein the roller chain is engaged with the driven sprocket, wherein the rotary actuator is operable to drive the driven sprocket to change the position of the driven sprocket relative to the roller chain.

7. The vehicle barrier system of claim 6, further comprising a static guide, wherein the at least one barrier member is configured to move relative to the static guide to transition between deployed and retracted positions, wherein the first end and the second end of the roller chain are secured to the static guide.

8. The vehicle barrier system of claim 6, wherein the actuation assembly further comprises at least one idler sprocket, wherein the roller chain is engaged with the idler sprocket, wherein the at least one idler sprocket is configured to redirect the roller chain.

9. The vehicle barrier system of claim 1, further comprising a plurality of substantially vertical post guides, wherein the substantially vertical post guides are secured to the housing, wherein each substantially vertical member is translatable within a corresponding substantially vertical post guide of the plurality of substantially vertical post guides.

10. The vehicle barrier system of claim 1, further comprising a substantially horizontal member, wherein each substantially vertical member of the plurality of substantially vertical members includes a respective top portion, wherein the substantially horizontal member is secured to the top portions of the substantially vertical members.

11. The vehicle barrier system of claim 1, further comprising at least one cover plate hingedly coupled with the housing, wherein the at least one cover plate is rotatable relative to the housing to selectively enclose the substantially vertical members and the at least one barrier member within the housing when the substantially vertical members are in the lowered position.

12. The vehicle barrier system of claim 11, further comprising at least one cover guide plate secured to at least one of the substantially vertical members, wherein the cover guide plate is configured to deflect the at least one cover plate away from a portion of the at least one barrier member while the substantially vertical members are being lowered relative to the housing.

13. The vehicle barrier system of claim 12, wherein the at least one cover guide plate is hingedly coupled to the at least one of the substantially vertical members, such that the cover guide plate is pivotable relative to the at least one of the substantially vertical members.

14. The vehicle barrier system of claim 11, further comprising a cover plate closure assembly engaged with the at least one cover plate, wherein the at least one barrier member is configured to engage the cover plate closure assembly during retraction of the at least one barrier member to close the at least one cover plate.

15. The vehicle barrier system of claim 14, wherein the at least one cover plate comprises a pair of cover plates, wherein the cover plate closure assembly comprises:

(i) a first beam coupled with one of the cover plates, (ii) a second beam coupled with the other of the cover plates, and (iii) a third beam joining the first beam to the second beam.

16. The vehicle barrier system of claim 1, wherein the at least one barrier member comprises a plurality of substantially horizontally oriented gate beams.

17. The vehicle barrier system of claim 1, further comprising a counterweight assembly secured to the at least one barrier member, wherein the counterweight assembly includes a counterweight having a first mass, wherein the plurality of substantially vertical members and the at least one barrier member together have a second mass, wherein the first mass is approximately equal to the second mass, wherein the counterweight assembly is configured to lower the counterweight in response to the substantially vertical members and the at least one barrier member being raised, wherein the counterweight assembly is configured to raise the counterweight in response to the substantially vertical members and the at least one barrier member being lowered.

18. The vehicle barrier system of claim 17, wherein the counterweight system further comprises:

(i) a roller chain, and (ii) at least one sprocket, wherein the roller chain is engaged with the at least one sprocket, wherein a first end of the roller chain is secured to the counterweight, wherein a second end of the roller chain is secured to the at least one barrier member.

19. A vehicle barrier system, comprising:

(a) a housing;

(b) a plurality of substantially vertical members;

(c) at least one barrier member coupled with the substantially vertical members, wherein the at least one barrier member is configured to stop a moving vehicle when the substantially vertical members are in a raised position relative to the housing;

(d) an actuation assembly operable to selectively raise and lower the substantially vertical members relative to the housing to selectively deploy and retract the at least one barrier member relative to the housing, wherein the actuation assembly comprises:

(i) a roller chain, wherein the roller chain has a first end and a second end, wherein a first end of the roller chain is fixed relative to the housing, wherein a second end of the roller chain is fixed relative to the housing, (ii) at least one sprocket engaged with the chain, and (iii) a rotary actuator coupled with the at least one sprocket, wherein the rotary actuator is operable to drive the at least one sprocket to climb the chain to thereby drive the substantially vertical members to the raised position relative to the housing, wherein the rotary actuator is mounted to the at least one barrier member such that the rotary actuator is configured to raise and lower with the at least one barrier member; and (e) a counterweight assembly secured to the at least one barrier member, wherein the counterweight assembly comprises a counterweight, wherein the counterweight assembly is configured to lower the counterweight in response to the substantially vertical members and the at least one barrier member being raised, wherein the counterweight assembly is configured to raise the counterweight in response to the substantially vertical members and the at least one barrier member being lowered, such that the counterweight assembly is configured to lower as the rotary actuator is being raised, and such that the counterweight assembly is configured to raise as the rotary actuator is being lowered;

wherein the roller chain is laterally interposed between the plurality of substantially vertical members and the counterweight.

20. A vehicle barrier system, comprising:

(a) a static guide;

(b) a plurality of substantially vertical members;

(c) at least one barrier member coupled with the substantially vertical members, wherein the at least one barrier member is configured to stop a moving vehicle when the substantially vertical members are in a raised position relative to the static guide, wherein the at least one barrier member defines a longitudinal axis; and (d) an actuation assembly operable to selectively raise and lower the substantially vertical members relative to the static guide to selectively deploy and retract the at least one barrier member relative to the static guide, wherein the static guide is configured to guide at least one of the substantially vertical members during deployment and retraction of the at least one barrier member, wherein the actuation assembly comprises:

(i) a powered rotary actuator, (ii) a drive shaft in communication with the rotary actuator, wherein the drive shaft is rotatable about an axis that is parallel to the longitudinal axis of the at least one barrier member, (iii) a rotary member in communication with the drive shaft, and (iv) a chain in communication with the rotary member, wherein the chain includes a pair of ends secured to the static guide, wherein a first end of the chain is fixedly secured to a first portion of the static guide at a first fixed location, wherein a second end of the chain is fixedly secured to a second portion of the static guide at a second fixed location, wherein the first fixed location is vertically higher than the second fixed location, wherein the powered rotary actuator is operable to change the position of the rotary member along the chain to thereby drive the rotary member along the chain between the first and second fixed locations of the respective first and second ends of the chain such that the rotary actuator is operable to drive the rotary member and the at least one barrier together toward the first end in response to rotation of the rotary actuator in a first direction, and such that the rotary actuator is operable to drive the rotary member and the at least one barrier together toward the second end in response to rotation of the rotary actuator in a second direction.

21. A vehicle barrier system, comprising:

(a) a housing;

(b) a plurality of substantially vertical members;

(c) at least one barrier member coupled with the substantially vertical members, wherein the at least one barrier member is configured to stop a moving vehicle when the substantially vertical members are in a raised position relative to the housing;

(d) an actuation assembly operable to selectively raise and lower the substantially vertical members relative to the housing to selectively deploy and retract the at least one barrier member relative to the housing, wherein the actuation assembly comprises a powered rotary actuator mounted to the at least one barrier member, wherein the actuation assembly is operable to convert rotary motion from the rotary actuator into linear movement of the at least one barrier member;

(e) at least one cover plate hingedly coupled with the housing, wherein the at least one cover plate is rotatable relative to the housing to selectively enclose the substantially vertical members and the at least one barrier member within the housing when the substantially vertical members are in the lowered position; and (f) at least one cover guide plate secured to at least one of the substantially vertical members, wherein the cover guide plate is configured to deflect the at least one cover plate away from a portion of the at least one barrier member while the substantially vertical members are being lowered relative to the housing.

* * * * *